US006217296B1

(12) United States Patent
Miyazawa et al.

(10) Patent No.: US 6,217,296 B1
(45) Date of Patent: Apr. 17, 2001

(54) VARIABLE DISPLACEMENT PUMP

(75) Inventors: Shigeyuki Miyazawa; Yuuichi Kimura; Tatsufumi Yamura; Takashi Shimo; Kazuyoshi Uchino; Masaaki Kogure, all of Saitama (JP)

(73) Assignee: Bosch Braking Systems Co., Ltd. (JP)

( * ) Notice: Subject to any disclaimer, the term of this patent is extended or adjusted under 35 U.S.C. 154(b) by 0 days.

(21) Appl. No.: 09/454,713

(22) Filed: Dec. 6, 1999

(30) Foreign Application Priority Data

| | | |
|---|---|---|
| Dec. 7, 1998 | (JP) | 10-346993 |
| Feb. 1, 1999 | (JP) | 11-023755 |
| May 28, 1999 | (JP) | 11-149734 |

(51) Int. Cl.[7] ..... F04B 49/00
(52) U.S. Cl. ..... 417/310; 418/26; 417/220
(58) Field of Search ..... 417/310, 220, 417/299, 213; 418/26

(56) References Cited

U.S. PATENT DOCUMENTS

| | | | | |
|---|---|---|---|---|
| 4,421,462 | * | 12/1983 | Ohe | 417/310 |
| 4,522,565 | * | 6/1985 | Stockton | 417/220 |
| 4,531,893 | * | 7/1985 | Okoh et al. | 417/220 |
| 5,226,802 | * | 7/1993 | Nakamura et al. | 417/299 |
| 5,518,380 | | 5/1996 | Fujii et al. | 418/26 |
| 5,538,400 | | 7/1996 | Konishi et al. | 417/220 |
| 5,562,432 | | 10/1996 | Semba et al. | 418/26 |
| 5,895,209 | * | 4/1999 | Miyazawa | 418/26 |
| 6,042,343 | * | 3/2000 | Semba et al. | 417/220 |
| 6,079,955 | * | 6/2000 | Miyazawa et al. | 417/213 |
| 6,120,256 | * | 9/2000 | Miyazawa | 417/220 |

FOREIGN PATENT DOCUMENTS

| | | | | |
|---|---|---|---|---|
| 4420370 | * | 12/1995 | (DE) | F04C/2/344 |
| 56-143383 | | 11/1981 | (JP) . | |
| 58-93978 | | 6/1983 | (JP) . | |
| 61-179084 | | 8/1986 | (JP) . | |
| 5-332241 | | 12/1993 | (JP) . | |
| 7-135068 | | 5/1995 | (JP) . | |
| 7-142153 | | 6/1995 | (JP) . | |
| 8-200241 | * | 8/1996 | (JP) | F04C/15/04 |
| 11-93861 | * | 4/1999 | (JP) | F04C/15/04 |

* cited by examiner

*Primary Examiner*—Teresa Walberg
*Assistant Examiner*—Leonid Fastovsky
(74) *Attorney, Agent, or Firm*—Townsend and Townsend and Crew LLP; Kenneth R. Allen

(57) ABSTRACT

A variable displacement pump includes pump bodies, a cam ring, first and second fluid pressure chambers, a rotor, a driving shaft, a pump chamber, a compression coil spring, a metering restrictor portion, and a control valve. A plunger damper is formed to incorporate the compression coil spring such that a distal end of the plunger damper abuts against a side portion of the cam ring in the second fluid pressure chamber. A small hole constituting the metering restrictor portion is formed at such a position that it is opened/closed by a slidable motion of the plunger damper during a swing motion of the cam ring, and such that it is partitioned from the second fluid pressure chamber, so that an opening area of the small hole changes in an interlocking manner to the swing motion of the cam ring.

5 Claims, 14 Drawing Sheets

ⓐ ~ ⓑ

ⓑ ~ ⓔ

VARIABLE DISPLACEMENT PUMP

BACKGROUND OF THE INVENTION

The present invention relates to a variable displacement pump used in, e.g., a pressure fluid utilizing device such as a power steering device for decreasing the force required to operate the steering wheel of a vehicle.

As a pump for a power steering device of this type, a displacement vane pump directly driven to rotate by a vehicle engine is used. In this displacement pump, the discharge flow rate increases or decreases in accordance with the rotational speed of the engine. A power steering device requires an auxiliary steering force which increases while the vehicle is stopped or is traveling at a low speed and decreases while the vehicle is traveling at a high speed. The characteristics of the displacement pump must be contradictory to this auxiliary steering force. Accordingly, a displacement pump having a large volume must be used so that it can maintain a discharge flow rate necessary to produce a required auxiliary steering force even during low-speed driving with a low rotational speed. For high-speed driving with a high rotational speed, a flow control valve that controls the discharge flow rate to a redetermined value or less is indispensable. For these reasons, the number of constituent components relatively increases, and the structure and path arrangement are complicated, inevitably leading to an increase in entire size and cost.

In order to solve these inconveniences, variable displacement vane pumps each capable of decreasing the discharge flow rate per revolution (cc/rev) in proportion to an increase in rotational speed are proposed in, e.g., Japanese Patent Laid-Open Nos. 56-143383 and 58-93978, U.S. Pat. Nos. 5,538,400, 5,518,380, and 5,562,432, and the like. According to these variable displacement pumps, a flow control valve provided to the displacement pump is unnecessary. The driving power can be decreased to provide an excellent energy efficiency.

An example of such a variable displacement vane pump will be described briefly with reference to FIG. 16 showing the pump structure in, e.g., U.S. Pat. No. 5,562,432 or the like. Referring to FIG. 16, reference numeral 1 denotes a pump body; 1*a,* an adapter ring; and 2, a cam ring. The cam ring 2 is free to swing in an elliptic space 1*b,* formed in the adapter ring 1*a* of the pump body 1, through a swing fulcrum pin 2*a* serving as a support shaft. A spring means (compression coil spring 2*b*) biases the cam ring 2 to the left in FIG. 16.

A rotor 3 is accommodated in the cam ring 2 to be eccentric on one side to form a pump chamber 4 on the other side. When the rotor 3 is rotatably driven by an external drive source, vanes 3*a* held to be movable forward/backward in the radial direction are projected and retracted. Reference numeral 3*b* denotes a driving shaft of the rotor 3. The rotor 3 is driven by the rotating shaft 3*b* to rotate in a direction indicated by an arrow in FIG. 16. In the following description, the pump chamber 4 is a space formed in the cam ring 2 on one side of the rotor 3 to have an almost crescent-like shape, and extends from a suction opening 7 (to be described later) to a discharge opening 8.

First and second fluid pressure chambers 5 and 6 are formed on two sides around the cam ring 2 in the elliptic space 1*b* of the adapter ring 1*a* set in the pump body 1, and serve as high- and low-pressure chambers, respectively. Paths 5*a* and 6*a* are open to the chambers 5 and 6, respectively, through a spool type control valve 10 (to be described later), to guide as the control pressure for swinging the cam ring 2 the fluid pressures obtained upstream and downstream of a metering restrictor formed in a pump discharge path 11.

In this example, a variable metering restrictor 12 is formed of a hole 12*a* formed in the side wall surface of the pump body 1 that forms the second fluid pressure chamber 6, and a side edge 12*b* of the cam ring 2 that moves to change the opening area by selectively covering the hole 12*a*. For this reason, the second fluid pressure chamber 6 is under the fluid pressure obtained downstream of the variable metering restrictor 12. This fluid pressure is guided to the low-pressure chamber of the control valve 10 through the path 6*a*.

Reference numeral 13 denotes a pump discharge path formed downstream of the variable metering restrictor 12.

In FIG. 16, a pump suction opening (suction port) 7 is formed to oppose a pump suction region 4A of the pump chamber 4. A pump discharge opening (discharge port) 8 is formed to oppose a pump discharge region 4B of the pump chamber 4. These openings 7 and 8 are formed in at least corresponding ones of a pressure plate and a side plate (not shown) serving as stationary wall portions for holding pump constituent elements composed of the rotor 3 and cam ring 2 by sandwiching them from two sides.

The cam ring 2 is biased by the compression coil spring 2*b* from the fluid pressure chamber 6 and is urged in a direction to keep the volume (pump volume) in the pump chamber 4 maximum. A seal member 2*c* is placed in the outer surface portion of the cam ring 2 to define the fluid pressure chambers 5 and 6, together with the swing fulcrum pin 2*a,* on the right and left sides.

The spool type control valve 10 is actuated by differential pressures P1 and P2 obtained upstream and downstream of the variable metering restrictor 12 serving as a metering orifice and formed between the pump discharge paths 11 and 13. The control valve 10 introduces a fluid pressure P3 corresponding to the magnitude of the pump discharge flow rate to the high-pressure fluid pressure chamber 5 outside the cam ring 2, to maintain a sufficiently large flow rate even immediately after the pump is started.

More specifically, as described above, when the fluid pressures obtained upstream and downstream of the variable metering restrictor 12 between the pump discharge paths 11 and 13 are controlled by the control valve 10 and guided into the fluid pressure chambers 5 and 6 on two sides of the cam ring 2, the cam ring 2 is swung in a required direction, as indicated by a solid arrow or a white arrow in FIG. 16, to change the volume of the pump chamber 4, so that the discharge flow rate can be controlled to match the pump discharge flow rate, as shown by the flow rate curve of FIG. 17. Also, flow rate control can be performed as follows. As the rotational speed of the pump increases, the discharge flow rate can be raised to a predetermined value, and this state is maintained. When the rotational speed of the pump is in a high speed range, the flow rate is decreased.

FIG. 16 described above shows a state that takes place from region A to B in FIG. 17. When the rotational speed of the pump reaches a predetermined value or more, the difference between the fluid pressures obtained upstream and downstream of the variable metering restrictor 12 increases. As a result, the cam ring 2 swings to the right (a direction indicated by a solid arrow) in FIG. 16 to restrict the variable metering restrictor 12. The discharge flow rate of the pump decreases in accordance with the restriction amount. When the variable metering restrictor 12 is restricted to the minimum position, the pump discharge flow rate is maintained at the predetermined value, as indicated in a region C.

While the pressure fluid utilizing device (for example, the power cylinder of the power steering device and indicated by PS in FIG. 16) is actuated to apply a load, when the differential pressures obtained upstream and downstream of the variable metering restrictor 12 become equal to or higher than a predetermined value, the control valve 10 introduces the fluid pressure P1 obtained upstream of the variable metering restrictor 12 as a control pressure to the high-pressure fluid pressure chamber 5 outside the cam ring 2, to prevent swing of the cam ring 2.

The pump body 1 is formed with a pump suction path 14 extending from a tank T to the pump suction region 4A of the pump chamber 4 through the low-pressure chamber of the spool type control valve 10. The pump discharge path 13 is formed with a direct driven type relief valve 15 serving as a pressure control valve. The relief valve 15 is formed at such a position that, when the pump discharge fluid pressure becomes equal to or higher than a predetermined value, it relieves the pressure fluid to the pump suction side (or tank T side) through the pump suction path 14.

In the variable displacement pump having the structure described above, the fluid pressure obtained downstream of the variable metering restrictor 12 is directly introduced to, of the pair of fluid pressure chambers 5 and 6 that swing the cam ring 2, the fluid pressure chamber 6. More specifically, the hole 12*a* formed in the side wall of the pump body 1 constituting the second fluid pressure chamber 6 and the outer surface of the cam ring 2 which swings form the variable metering restrictor 12. The fluid pressure is supplied to the pump discharge path 13 through the second fluid pressure chamber 6.

In the conventional variable displacement pump having the structure described above, the cam ring 2 is swung by the pressures of the first and second fluid pressure chambers 5 and 6 and the biasing force of the compression coil spring 2*b* formed in the second fluid pressure chamber 6 in accordance with an increase/decrease of the supply flow rate of the fluid accompanying a change in rotational speed of the pump, thereby controlling the pump volume to a required value. A problem exists, however, in appropriately controlling the swing motion of the cam ring 2.

Assume that the rotational speed of the pump reaches a high range. The first fluid pressure chamber 5 which introduces the fluid pressure obtained upstream of the variable metering restrictor 12 by means of the control valve 10 has a structure of introducing the fluid pressure through the path 5*a* partly having a restrictor. When the cam ring 2 swings toward the first fluid pressure chamber 5, a required braking force can be exerted on the cam ring 2 by the damper function of the restrictor portion of the path 5*a*.

In contrast to this, merely the compression coil spring 2*b* is provided to the second fluid pressure chamber 6. A means having the damper function of braking the cam ring 2 is not provided to the second fluid pressure chamber 6, unlike in the first fluid pressure chamber 5 described above.

When the cam ring 2 swings toward the second fluid pressure chamber 6, although a spring force generated by flexure of the compression coil spring 2*b* may somewhat act, a braking force produced by the damper function cannot be effected. Accordingly, the swing motion of the cam ring 2 toward the first and second fluid pressure chambers 5 and 6 (particularly the swing motion from the first fluid pressure chamber 5 toward the second fluid pressure chamber 6) tends to become unstable. Then, the cam ring 2 may vibrate or pulsation occurs in the pump discharge fluid pressure inevitably. This pulsation state is indicated by a broken line in FIG. 17.

This will be described in detail. When the pump discharge fluid pressure flows in the form of a jet into the second fluid pressure chamber 6 through the hole 12*a* formed in the fluid pressure chamber 6 and when the hole 12*a* is to be closed or opened by the outer edge of the cam ring 2, the cam ring 2 tends to vibrate. When the jet from the hole 12*a* is blocked by the outer edge of the cam ring 2 or is passed through the hole 12*a,* pulsation increases in the pump discharge side. When such vibration or pulsation occurs, in a power steering device, the steering force may fluctuate, or the noise such as the sound produced by the fluid may increase.

In the variable displacement pump described above, it is sought for to simplify the path structure for the pressure fluid in the pump body and the structure of the control valve that swings the cam ring, and to make compact the structure of the entire pump. In a variable displacement pump, it is sought for to take countermeasures that can simplify the structure of the entire pump as much as possible and the structure of the path in the pump body through which the pressure fluid flows, and to improve the machinability and assembly easiness, thereby decreasing the manufacturing cost.

SUMMARY OF THE INVENTION

It is, therefore, a principal object of the present invention to provide a variable displacement vane pump which can discharge a fluid pressure with predetermined supply flow rate characteristics.

It is, therefore, another object of the present invention to provide a variable displacement vane pump in which vibration occurring in a cam ring that swings in a pump body and pulsation in the pump discharge fluid pressure caused by the vibration are attenuated so that the problem of noise resulting from the vibration and the pulsation can be solved.

It is, therefore, still another object of the present invention to provide a variable displacement vane pump in which the motion of a cam ring that swings in a pump body is controlled to a normal state so that the cam ring can be swung more smoothly and reliably than in a conventional variable displacement vane pump.

In order to achieve these objects, according to the present invention, there is provided a variable displacement pump comprising pump bodies having an inner space and formed with a pump suction path and pump discharge paths communicating with the inner space, a cam ring swingably supported in the inner space of the pump bodies through a swing fulcrum formed on part of an outer surface of the cam ring to extend in an axial direction, first and second fluid pressure chambers divisionally formed in the inner space of the pump bodies with respect to the outer surface of the cam ring through seal means, a rotor having a plurality of vanes and arranged inside the cam ring, a rotating shaft axially supported by the pump bodies and mounted with the rotor, a pump chamber having an opening for the suction path and an opening for the discharge paths and formed between an inner surface of the cam ring and an outer surface of the rotor, biasing means for biasing the cam ring from the second fluid pressure chamber toward the first fluid pressure chamber, a metering restrictor provided midway along the discharge paths of a pressure fluid discharged from the pump chamber, and a control valve connected to the discharge paths formed upstream and downstream, respectively, of the metering restrictor and to the first and second fluid pressure chambers and driven by fluid pressures obtained upstream and downstream of the metering restrictor, wherein a plunger damper is formed to incorporate the biasing means such that a distal end thereof abuts against a side portion of the cam ring in the second fluid pressure chamber, and a variable metering restrictor constituting the metering restrictor is formed at a position, where the variable metering restrictor is opened/closed by a slidable motion of the plunger damper during a swing motion of the cam ring and is partitioned from the second fluid pressure chamber, so that an opening area of the variable metering restrictor changes in an interlocking manner to the swing motion of the cam ring.

BRIEF DESCRIPTION OF THE DRAWINGS

FIGS. 8A and 8B show a variable displacement pump having drooping type flow rate characteristics according to the second embodiment of the present invention, in which FIG. 8A is a sectional view of the main part of the pump rotating at a low rotational speed (from ⓐ to immediately before ⓑ in FIG. 5 described above), and FIG. 8B is an enlarged view of the main part of the same;

DESCRIPTION OF THE PREFERRED EMBODIMENTS

Figure 1:
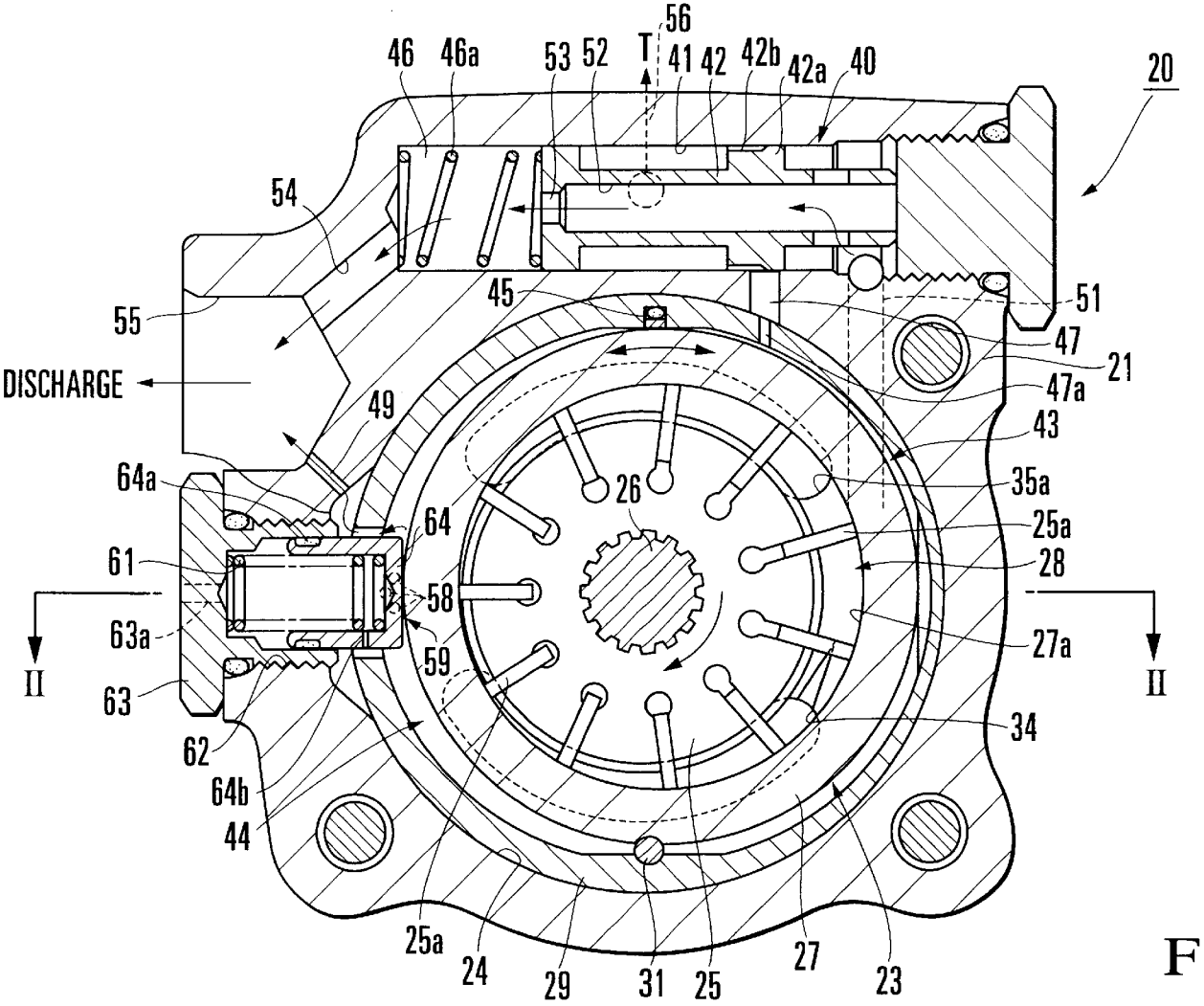
FIG. 1 is a sectional view of the main part of a variable displacement pump having drooping type flow rate characteristics according to the first embodiment of the present invention, in a state wherein the pump rotates at a low rotational speed (from ⓐ to immediately before ⓑ in FIG. 5)
Figure 2:
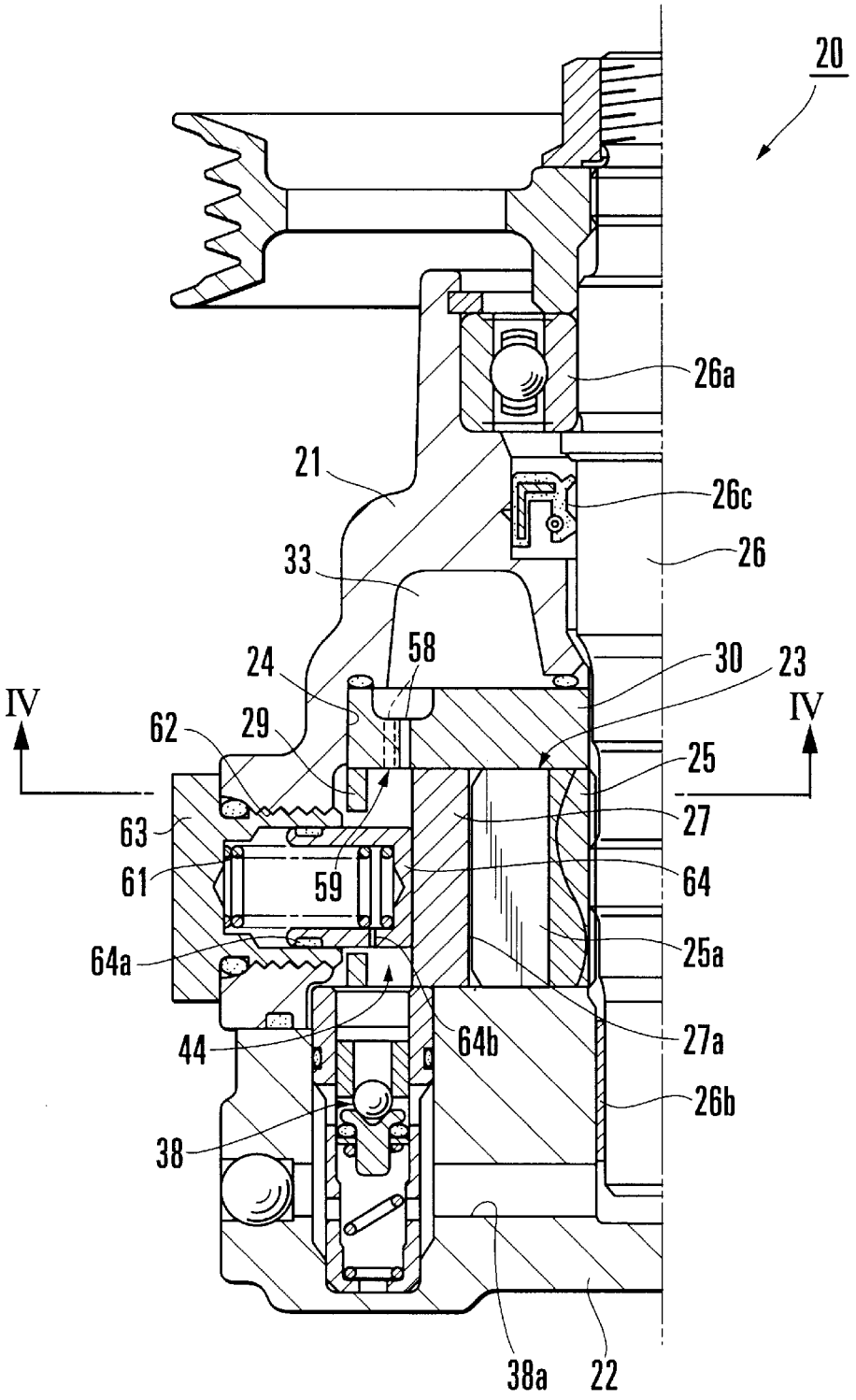
FIG. 2 is a sectional view of one side obtained taken along the line II—II of FIG. 1.

FIGS. 1 to 7B show a variable displacement pump according to the first embodiment of the present invention. The first embodiment exemplifies a case wherein a vane pump according to the present invention is a vane type oil pump serving as the oil pressure generating source of a power steering device, and has so-called drooping characteristics. According to the drooping characteristics, as the rotational speed of the pump increases, the discharge flow rate from the pump decreases to a predetermined value lower than the maximum discharge flow rate, and is maintained at this predetermined value. In this embodiment, the pump has a direct driven type relief valve, as shown in FIG. 2.

Referring to FIGS. 1 and 2, a vane type variable displacement pump denoted by reference numeral 20 has a front body 21 and a rear body 22 constituting a pump body. The entire portion of the front body 21 forms a substantially cup-like shape, as shown in FIGS. 1 and 2. A housing space 24 for housing pump constituent elements 23 as a pump cartridge is formed in the front body 21. The rear body 22 is integrally combined with the front body 21 to close the opening end of the housing space 24. A driving shaft 26 for externally, rotatably driving a rotor 25 of the pump constituent elements 23 extends through the front body 21, and is rotatably supported by the front body 21 through bearings 26*a* and 26*b* (the bearing 26*a* is disposed on the front body 21 while the bearing 26*b* is disposed on the rear body 22). Reference numeral 26*c* denotes an oil seal.

A cam ring 27 has an inner cam surface 27*a* fitted on the outer surface of the rotor 25 having vanes 25*a*, to form a pump chamber 28 between the inner cam surface 27*a* and rotor 25. The cam ring 27 is movably arranged in an adapter ring 29 that fits the inner wall portion of the housing space 24, to be able to change the volume (pump volume) of the pump chamber 28, as will be described later.

The adapter ring 29 serves to hold the cam ring 27 in the housing space 24 of the front body 21 to be movable.

Figure 3A:
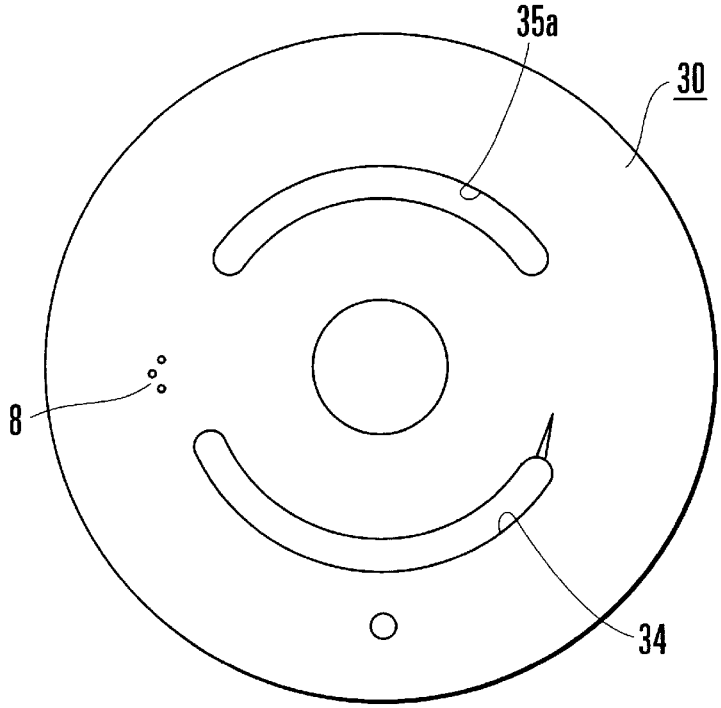
FIG. 3A is a diagram for explaining the relationship between three small holes formed in a pressure plate and the outer surface of a cam ring in accordance with the swing motion.
Figure 3B:
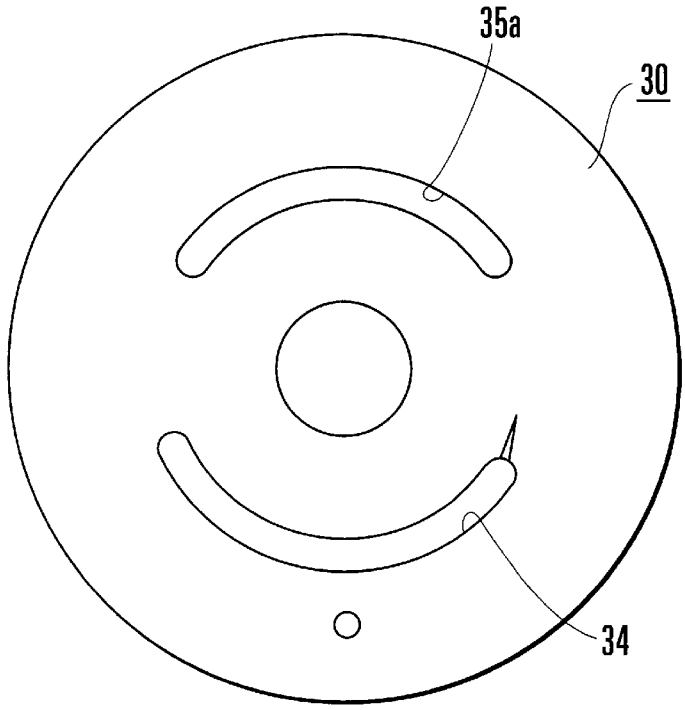
FIG. 3B is a diagram for explaining the shape of the pressure plate in the pump structure when a variable displacement pump having the dropping type flow rate characteristics shown in FIGS. 1 and 2 is used as a constant flow rate type pump.
Figure 4:
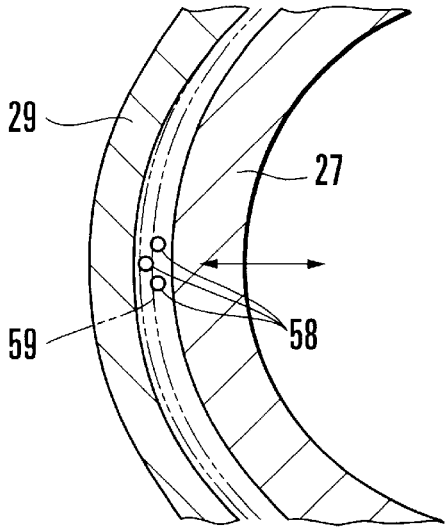
FIG. 4 is a side view of the pressure plate disposed on one side of the cam ring in the variable displacement pump shown in FIGS. 1 and 2.

Referring to FIG. 2 and FIGS. 3A and 3B, a pressure plate 30 is stacked on the front body 21 of the pump cartridge (pump constituent elements 23), constituted by the rotor 25, cam ring 27, and adapter ring 29 described above, to press against it. The end face of the rear body 22 is pressed against the opposite side surface of the pump cartridge as a side plate. When the front body 21 and rear body 22 are integrally assembled, the pump cartridge is assembled in a required state. These members construct the pump constituent elements 23.

The pressure plate 30 and the rear body 22 stacked on it through the cam ring 27 to serve as the side plate are integrally assembled and fixed to each other while they are positioned in the rotational direction by a swing fulcrum pin 31 (to be described later) and appropriate rotation preventive means (not shown). The swing fulcrum pin 31 also serves as a positioning pin and axial support portion for enabling the cam ring 27 to swing, and has a seal function to define a fluid pressure chamber where the cam ring 27 swings.

A pump discharge pressure chamber 33 is formed in the housing space 24 of the front body 21 on the bottom portion side. The pump discharge pressure chamber 33 exerts the pump discharge pressure on the pressure plate 30. A pump discharge opening 34 is formed in the pressure plate 30 to guide the hydraulic oil from the pump chamber 28 to the pump discharge pressure chamber 33.

Although not shown, a pump suction opening 35 (an opening position with respect to the pump chamber 28 as shown in FIG. 1) is formed in part of the rear body 22. A suction fluid entering from a tank T through the suction opening 35 flows from a suction port (not shown) formed in part of the rear body 22 into a pump suction path (not shown) formed in the rear body 22, and is supplied into the pump chamber 28 through the pump suction opening 35 formed in the end face of the rear body 22. In FIGS. 3A and 3B, a groove 35*a* is formed in the pressure plate 30 to oppose the pump suction opening 35.

A control valve 40 is composed of a spool 42 and a valve hole 41 formed in the upper portion of the front body 21 in a direction perpendicular to the driving shaft 26. The control valve 40 controls the fluid pressures to be introduced into first and second fluid pressure chambers 43 and 44, divisionally formed on two sides of the cam ring 27 in the adapter ring 29 by the swing fulcrum pin 31 and a seal member 45 axially symmetric to it.

Although not shown, a path 51 (indicated by broken lines in FIG. 1) extending from the pump discharge pressure chamber 33 is connected to one end of the valve hole 41.

A path 52 is formed in the spool 42 in the axial direction. A stationary metering restrictor 53 is formed in part of the path 52, in this case, on a side of a spring chamber 46 having a spring 46*a* formed on the other end of the spool 42. A pump discharge port 55 is formed on the outer end of the spring chamber 46 through a pass hole 54, to supply a hydraulic oil to a power steering device (not shown) serving as a pressure fluid utilizing device (hydraulic pressure utilizing device).

As described above, the spool 42 introduces the fluid pressures obtained upstream and downstream of the stationary metering restrictor 53 to the first and second fluid pressure chambers 43 and 44 in accordance with the rotational speed of the pump. The fluid pressure obtained upstream of the stationary metering restrictor 53 is introduced into the valve hole 41 of the control valve 40 through a path hole 47 formed close to one end of the valve hole 41. The path hole 47 is blocked by a land 42*a* in the initial state when the spool 42 is located left in FIG. 1. At this time, the fluid pressure from the tank T is introduced via a pump suction path 56 open in this portion through a central annular groove of the spool 42, through a gap path 42*b* around the small-diameter portion of the land 42*a*.

As the spool 42 is moved to the left in FIG. 1 by the differential pressure between the fluid pressures obtained upstream and downstream of the stationary metering restrictor 53 and that of a variable metering restrictor (described later), the spool 42 is disconnected from the pump suction side described above, and the fluid pressure obtained upstream of the upstream is introduced to the first fluid pressure chamber 43 through the path hole 47. The fluid pressure supplied to the path hole 47 is controlled by the control valve 40 as shown in FIGS. 6A and 6B, and FIGS. 7A and 7B corresponding to FIG. 5.

A portion of the path hole 47 forms a damper restrictor 47*a*.

The fluid pressure obtained downstream of the stationary metering restrictor 53 acts on the second fluid pressure chamber 44 through a path hole 49 open to part of the pump discharge port 55 to serve as a damper restrictor.

Part of the pump discharge path, i.e., in this embodiment, paths formed by three small holes 58 formed in the pressure plate 30, branch from the pump discharge pressure chamber 33 independently of the discharge path 51, and open to the second fluid pressure chamber 44. The opening ends of the small holes 58 and the edge portion of the outer surface of the cam ring 27 form a variable metering restrictor 59. The fluid pressure passing through the variable metering restrictor 59 flows through the second fluid pressure chamber 44 and the notched portion of the adapter ring 29 to be supplied to the pump discharge port 55 through the path hole 49.

Referring to FIGS. 1 and 2, a compression coil spring 61 biases the cam ring 27. The compression coil spring 61 is arranged in a circular space opposing part of the second fluid pressure chamber 44. This circular space is formed in the cylindrical portion of a plug 63 screwed to close a hole 62 formed from the outside of the front body 21. In this cylindrical portion, a plunger damper 64 having one open end abuts against the outer surface of the cam ring 27 due to the spring force of the compression coil spring 61. The plunger damper 64 always exerts the biasing force of the compression coil spring 61 on the cam ring 27 regardless of the swing motion of the cam ring 27. In FIGS. 1 and 2, an O-ring 64*a* serves as a seal member for sealing the gap between the outer surface of the plunger damper 64 and the cylindrical portion of the plug 63.

In part of the plunger damper 64, a damper restrictor 64*b* is formed of a small hole through which the interior of the plunger damper 64 where the compression coil spring 61 is disposed, and the second fluid pressure chamber 44 communicate with each other. In place of the damper restrictor 64*b*, a bleed hole 63*a* may be formed in part of the plug 63 to open to the atmosphere. The bleed hole 63*a* serves to achieve a damper function together with the compression coil spring 61 and plunger damper 64.

The damper restrictor 64*b* may be formed to have a hole diameter of, e.g., about 0.6 mm. The O-ring 64*a* is fitted on the plunger damper 64 to seal its outer surface. The O-ring 64*a* also suppresses vibration of the cam ring 27.

In FIG. 2, a relief valve 38 is formed in part of the rear body 22. The relief valve 38 opens to the second fluid pressure chamber 44. Thus, the relief valve 38 is connected to part of the pump discharge path so that the pump discharge fluid pressure can be relieved to the pump suction side through a path 38*a* formed in the rear body 22.

In the above vane type variable displacement pump 20, the arrangement other than that described above is identical to that conventionally known widely, and a detailed description thereof will accordingly be omitted.

According to the variable displacement pump 20 having the above structure, the discharge paths 51, 52, 54, 58, and 49 extending from the pump discharge pressure chamber 33 are divided into two systems consisting of one provided with the stationary metering restrictor 53 and one provided with the variable metering restrictor 59. With the fluid pressures obtained upstream of the metering restrictors 53 and 59 and the pump suction fluid pressure (tank pressure), the control pressure controlled by the control valve 40 is introduced into the first fluid pressure chamber 43 located on one side in the swing direction of the cam ring 27. The fluid pressures obtained downstream of the metering restrictors 53 and 59 are introduced into the second fluid pressure chamber 44 located on the other side in the swing direction of the cam ring 27.

Figure 5:
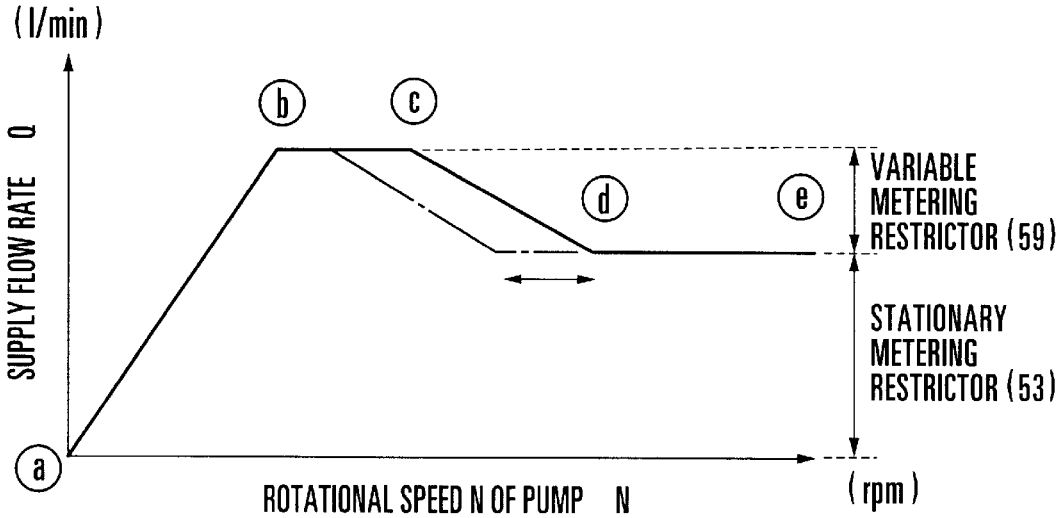
FIG. 5 is a graph for explaining the supply flow rate of the variable displacement pump shown in FIGS. 1 and 2 as a function of the rotational speed of the pump.

With this structure, the cam ring 27 can be swung in a required state in accordance with the magnitude of the pump discharge flow rate, and the supply flow rate to the pump discharge side can be maintained at a constant value, or an arbitrary value equal to or less than the predetermined value, as the rotational speed of the pump increases, as shown in FIG. 5.

Figure 6A:
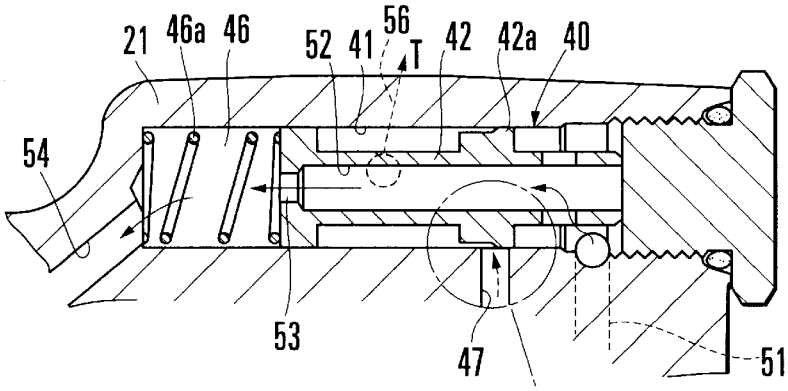
FIG. 6A is a sectional view of a control valve portion to explain a control pressure applied by a control valve to a first fluid pressure chamber when the pump rotates at a low rotational speed (from ⓐ to immediately before ⓑ in FIG. 5)
Figure 6B:
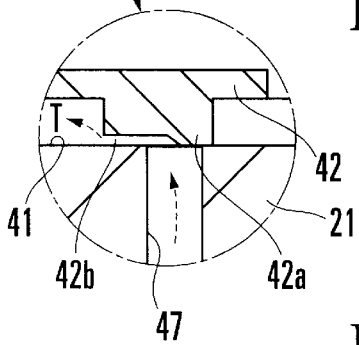
FIG. 6B is an enlarged view of the main part of the same.

Referring to FIG. 5, when the rotational speed of the pump increases from a low speed range to a medium speed range, the supply flow rate changes as indicated by ⓐ–ⓑ and ⓒ. As shown in FIGS. 6A and 6B, when the pump rotates at a low rotational speed, the control valve 40 guides the pump suction fluid pressure (tank pressure) to the first fluid pressure chamber 43 through the path hole 47 and damper restrictor 47*a,* to maintain a constant supply flow rate determined by the differential pressure obtained from the restriction amounts of the metering restrictors 53 and 59.

Figure 7A:
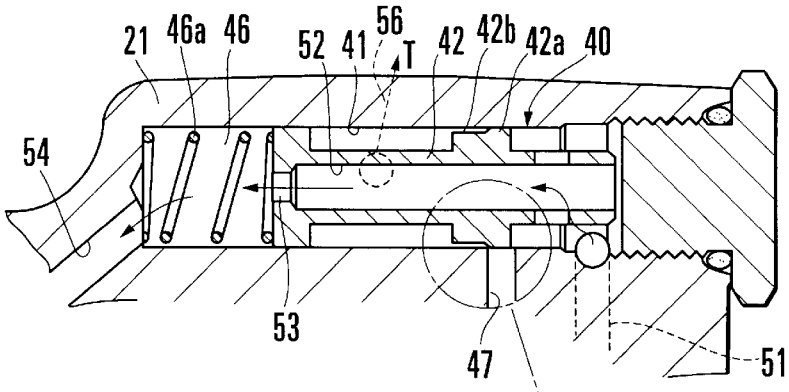
FIG. 7A is a sectional view of the control valve portion to explain the control pressure applied by the control valve to the first fluid pressure chamber when the pump rotates at a low rotational speed (from ⓑ to ⓒ in FIG. 5)
Figure 7B:
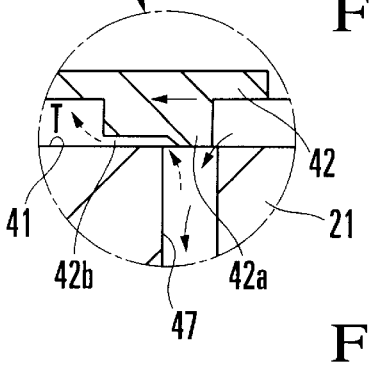
FIG. 7B is an enlarged view of the main part of the same.

When the rotational speed of the pump reaches a high speed range, the spool 42 of the control valve 40 moves to the left, as shown in FIGS. 7A and 7B, to switch the pressure in the path hole 47 extending to the first fluid pressure chamber 43 to the fluid pressure obtained upstream of the metering restrictor 53 or 59. Accordingly, the cam ring 27 swings toward the second fluid pressure chamber 44 where the compression coil spring 61 is provided, to gradually close the variable metering restrictor 59.

When the small holes 58 constituting the variable metering restrictor 59 are completely closed by the outer surface of the cam ring 27, the control valve 40 is controlled by the differential pressure between the fluid pressures obtained upstream and downstream of the stationary metering restrictor 53, so that the determined flow rate can be maintained (indicated by ⓓ–ⓔ in FIG. 5). These flow rate characteristics are so-called drooping characteristics.

When the relationship between the small holes 58 constituting the variable metering restrictor 59 and the opening amount determined by the displacement of the outer edge of the cam ring 27 is changed, the flow rate characteristics can be changed as indicated by an alternate long and short dashed line in FIG. 5.

In this embodiment, three small holes 58 described above are used. The variable metering restrictor 59 formed by the small holes 58 has a smaller opening amount than that of a conventional widely-known variable restrictor. The variable metering restrictor 59 is not limited to be formed of the three small holes 58 opened/closed by the outer edge of the cam ring 2 to change their opening area, as shown in FIGS. 1 to 4, but can be formed of one or more small holes 58.

The swing amount of the cam ring 27 is, e.g., about 1.9 mm with the existing product. If a plurality of small holes 58 (the total opening amount of which is identical to that obtained when the variable metering restrictor 59 is formed of one small hole 58) are formed, the opening area obtained by restriction can be changed by small displacement of the cam ring 27, which is convenient in setting the pump performance. In this embodiment, as the three small holes 58, for example, one 1-mm diameter small hole 58 (the leading end side in the displacing direction of the cam ring 27) and two 1.1-mm diameter small holes 58 (the trailing end side in the displacing direction) may be used. However, the present invention is not limited to this. To change the characteristics as described above, these hole diameters may be appropriately changed, the opening positions may be shifted so that the small holes are aligned in the moving direction of the cam ring 27, or the opening amounts may be varied along the moving direction.

The small holes 58 need not be circular, but can be square or can have any other shape.

The first and second fluid pressure chambers 43 and 44 for swinging the cam ring 27 are connected to the control valve 40 and the pump discharge path (pump discharge port 55) through the damper restrictors 47*a* and 49. When the cam ring 27 swings in accordance with the differential pressure between the fluid pressures obtained upstream and downstream of the stationary metering restrictor 53 and the differential pressure between the fluid pressures obtained upstream and downstream of the variable metering restrictor 59 due to an increase/decrease in rotational speed of the pump, a required braking force can be applied to the cam ring 27 in two swing directions.

The damper restrictor 47*a* described above may have a hole diameter of, e.g., about 1.2 mm. The path hole 49 serving as a damper restrictor located downstream of the variable metering restrictor 59 may be formed to have a diameter of, e.g., about 2 mm.

According to this structure, an appropriate braking force can be applied to the cam ring 27 when it swings toward the first or second fluid pressure chamber 43 or 44. The cam ring 27 can thus be swung smoothly in a required state so the cam ring 27 does not vibrate or pulsation is not produced on the pump discharge side. It suffices if the path hole 49 described above to serve as the damper restrictor is formed downstream of the stationary metering restrictor 53. Hence, the path hole 49 can communicate with, e.g., the spring chamber 46 of the control valve 40.

In this embodiment, the biasing force of the compression coil spring 61 serving as the biasing means is exerted on the cam ring 27 through the plunger damper 64. Therefore, a biasing force and a braking force can be appropriately exerted on the cam ring 27, and a smooth swing motion can be obtained more effectively.

To appropriately control the motion of the plunger damper 64, the bleed hole 63*a* is formed, and the space where the compression coil spring 61 is provided is open to the atmosphere through a predetermined restrictor, so that the effect is further improved.

In the variable displacement pump 20 according to the first embodiment, the pump has so-called drooping type supply flow rate characteristics. However, the present invention is not limited to this, and the supply flow rate characteristics can be easily changed to constant flow rate type characteristics.

More specifically, in a constant flow rate type pump, a variable metering restrictor is not required, unlike in the drooping type pump described above. Thus, the small holes 58 in the pressure plate 30 that open to the second fluid pressure chamber 44 may be omitted, as shown in FIG. 3B. The stationary metering restrictor 53 in the spool 42 of the control valve 40 may be formed to have an appropriate restricting diameter in accordance with the required pump characteristics.

The path hole 49 which guides the fluid pressure obtained downstream of the stationary metering restrictor 53 formed in the spool 42 of the control valve 40 may be formed to have such a diameter that it serves as a restricting portion. Alternatively, a restricting portion may be formed in part of the path hole 49.

Even with this structure, a damper effect to the cam ring 27 can obviously be exerted on the second fluid pressure chamber 44 as well with the plunger damper 64 and the path hole 49 serving as the damper restrictor. Therefore, even in the pump having this structure, vibration produced when the cam ring 27 swings can be attenuated, and pulsation on the pump discharge side can be decreased, so that noise is suppressed, in the same manner as in the embodiment described above.

As described above, in the pump structure according to the first embodiment, of the variable displacement pump 20, components except for those constituting the variable metering restrictor can be shared between the drooping type pump and the constant flow rate type pump, and any change in specifications can be coped with simply.

Figure 8A:
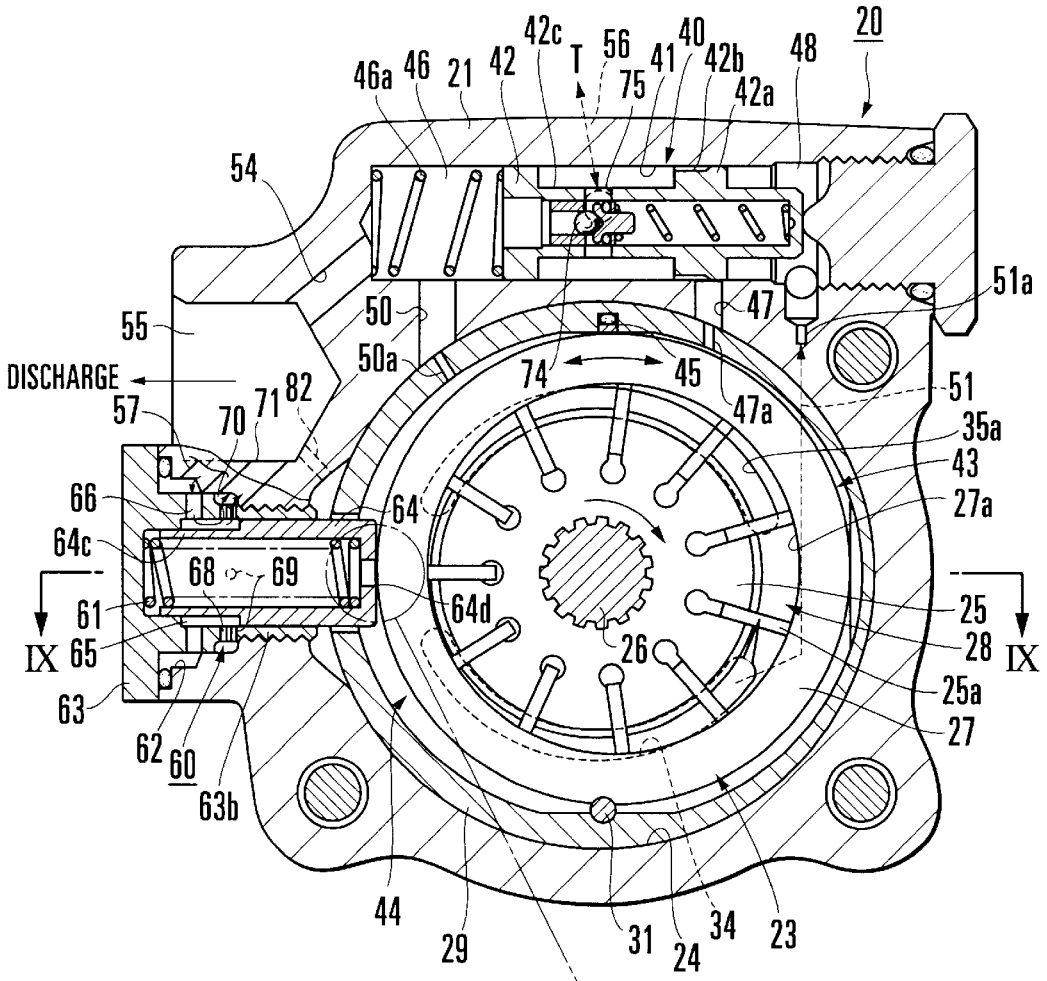
Figure 8B:
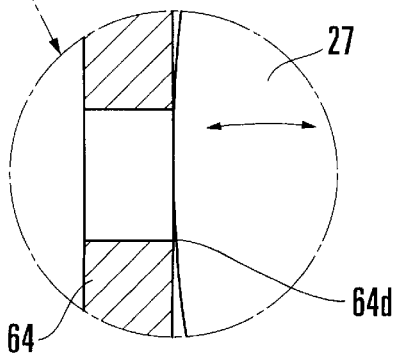
Figure 9:
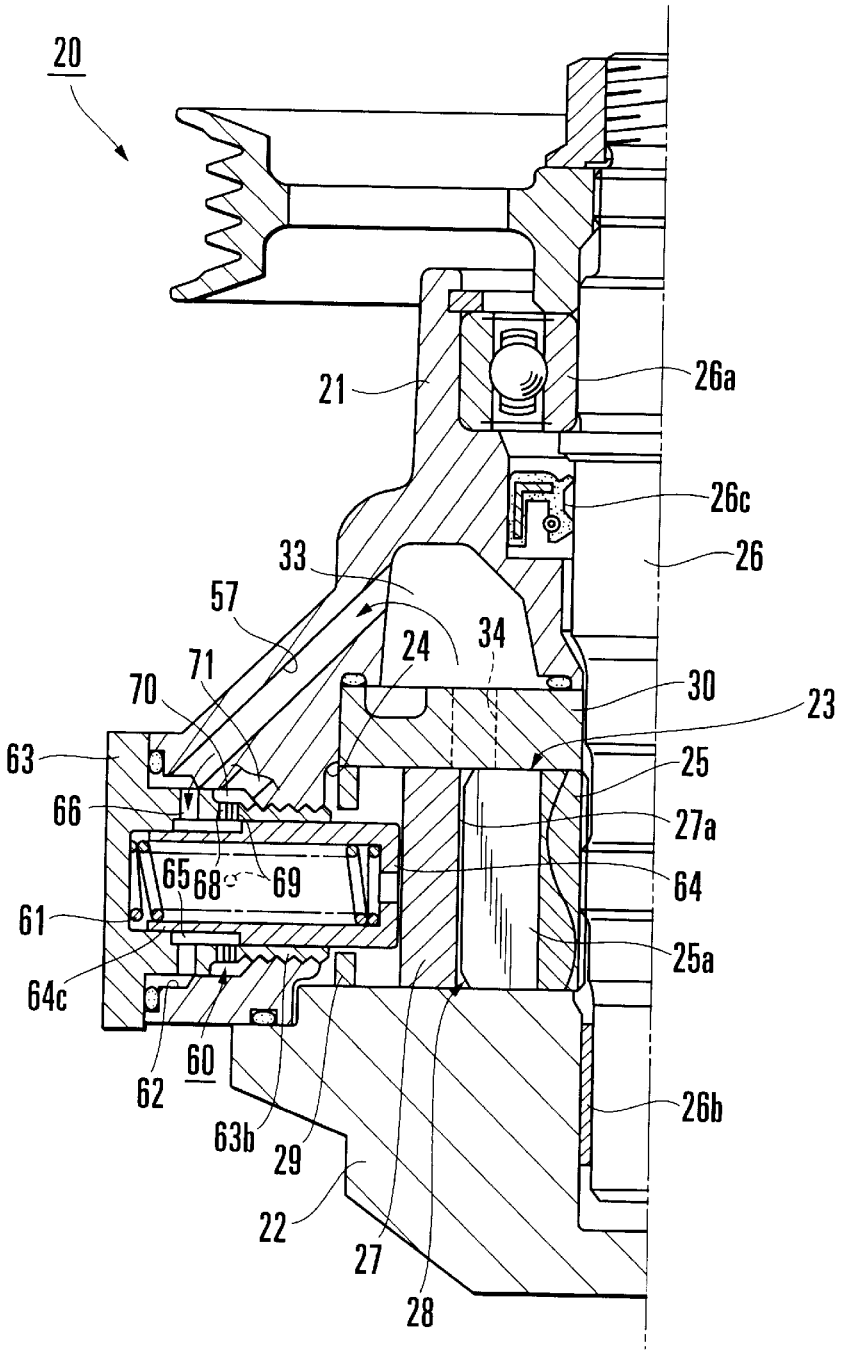
FIG. 9 is a sectional view of one side taken along the line IX—IX of FIG. 8A.
Figure 10:
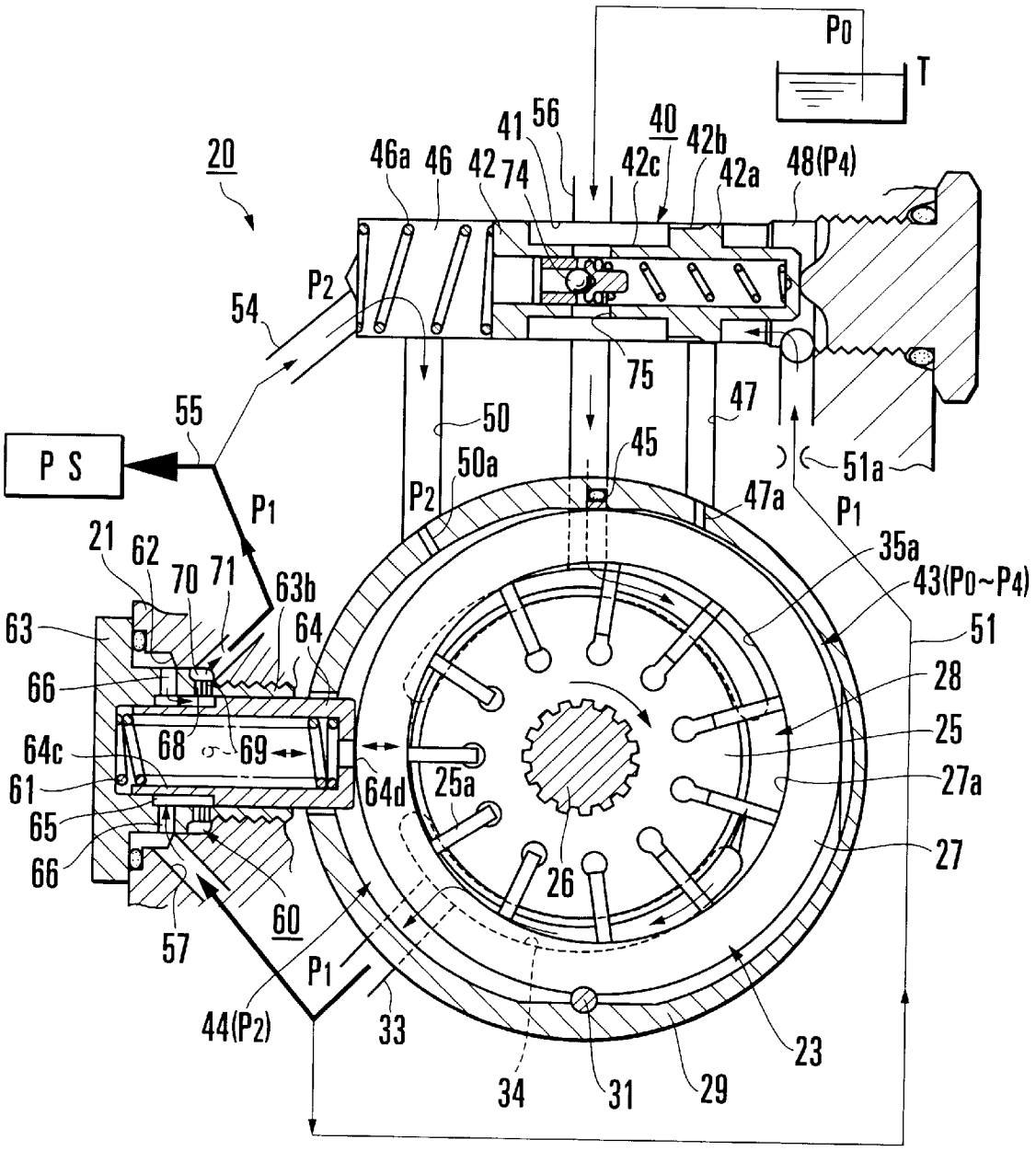
FIG. 10 is a view for explaining the outline of the entire flow of the fluid in the variable displacement pump shown in FIGS. 8A and 8B and FIG. 9.
Figure 11B:
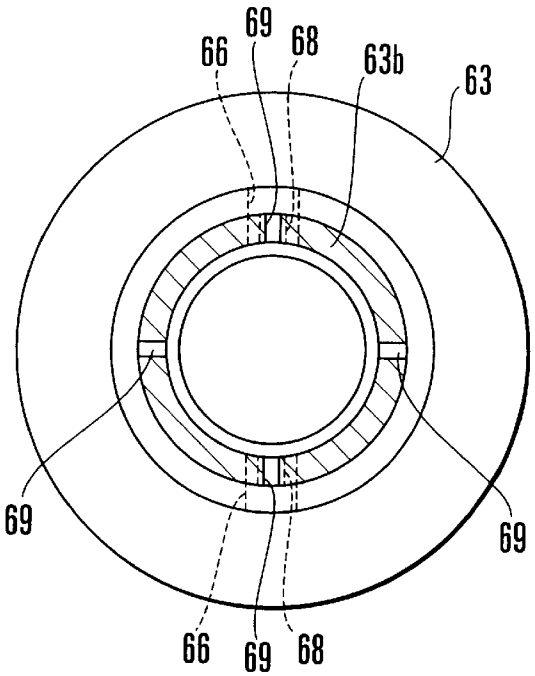
FIG. 11B is a sectional view of the main part taken where small holes serving as the variable metering restrictors of the plug are formed.
Figure 11A:
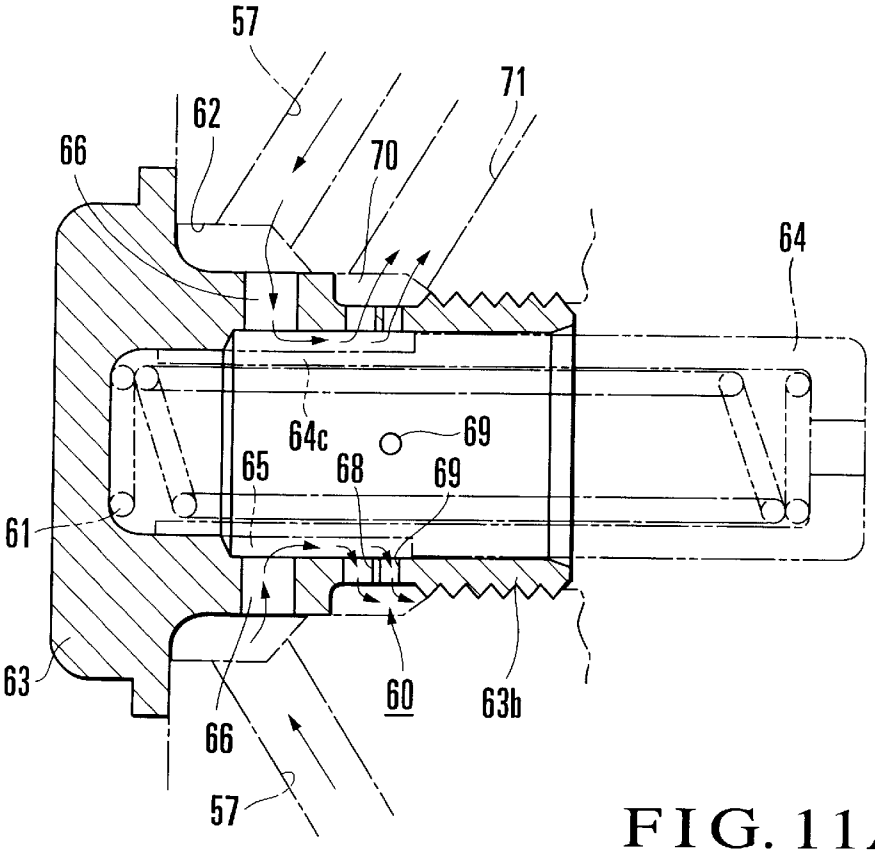
FIG. 11A is a side sectional view for explaining the relationship between a plug, which forms a metering restrictor portion comprised of a stationary metering restrictor and variable metering restrictors and which characterizes the second embodiment of the present invention, and components related to the plug.

FIGS. 8A to 11 show a variable displacement pump according to the second embodiment of the present invention. The second embodiment exemplifies a case wherein a vane pump according to the present invention is a vane type oil pump serving as the oil pressure generating source of a power steering device, and has so-called drooping characteristics. According to the drooping characteristics, as the rotational speed of the pump increases, the discharge flow rate from the pump decreases to a predetermined value lower than the maximum discharge flow rate, and is maintained at this predetermined value. In this embodiment, the pump has a direct driven type relief valve, as shown in FIGS. 8A and 8B, and FIG. 10.

Referring to FIGS. 8A and 8B, and FIG. 9, a vane type variable displacement pump denoted by reference numeral 20 has a front body 21 and a rear body 22 constituting a pump body, in the same manner as in the first embodiment described above. The entire portion of the front body 21 forms a substantially cup-like shape, as shown in FIGS. 8A and 8B, and FIG. 9. A housing space 24 for housing pump constituent elements 23 as a pump cartridge is formed in the front body 21. The rear body 22 is integrally combined with the front body 21 to close the opening end of the housing space 24. A driving shaft 26 for externally, rotatably driving a rotor 25 constituting the pump constituent elements 23 extends through the front body 21, and is rotatably supported by the front body 21 through bearings 26*a* and 26*b*. Reference numeral 26*c* denotes an oil seal.

A cam ring 27 has an inner cam surface 27*a* fitted on the outer surface of the rotor 25 having vanes 25*a*, to form a pump chamber 28 between the inner cam surface 27*a* and rotor 25. The cam ring 27 is movably arranged in an adapter ring 29 that fits the inner wall portion of the housing space 24, to be able to change the volume (pump volume) of the pump chamber 28, as will be described later.

The adapter ring 29 serves to hold the cam ring 27 in the housing space 24 of the front body 21 to be movable.

Referring to FIG. 9, a pressure plate 30 is stacked on the front body 21 of the pump cartridge (pump constituent elements 23), constituted by the rotor 25, cam ring 27, and adapter ring 29 described above, to press against it. The end face of the rear body 22 is pressed against the opposite side surface of the pump cartridge as a side plate. When the front body 21 and rear body 22 are integrally assembled, the pump cartridge is assembled in a required state. These members construct the pump constituent elements 23.

The pressure plate 30 and the rear body 22 stacked on it through the cam ring 27 to serve as the side plate are integrally assembled and fixed to each other while they are positioned in the rotational direction by a swing fulcrum pin 31 (to be described later) and appropriate rotation preventive means (not shown). The swing fulcrum pin 31 also serves as a positioning pin and axial support portion for enabling the cam ring 27 to swing, and has a seal function to define a fluid pressure chamber where the cam ring 27 swings.

A pump discharge pressure chamber 33 is formed in the housing space 24 of the front body 21 on the bottom portion side. The pump discharge pressure chamber 33 exerts the pump discharge pressure on the pressure plate 30. A pump discharge opening 34 is formed in the pressure plate 30 to guide the hydraulic oil from the pump chamber 28 to the pump discharge pressure chamber 33.

Although not shown, a pump suction opening 35 (an opening position with respect to the pump chamber 28 is shown in FIG. 1) is formed in part of the rear body 22. A suction fluid entering from a tank T (pump suction side) through the suction opening 35 flows from a suction port (not shown) formed in part of the rear body 22 into a pump suction path (not shown) formed in the rear body 22, and is supplied into the pump chamber 28 through the pump suction opening 35 open to the end face of the rear body 22. In FIG. 8A, a groove 35*a* is formed in the pressure plate 30 to oppose the pump suction opening 35 on the rear body 22 side.

A control valve 40 is composed of a spool 42 and a valve hole 41 formed in the upper portion of the front body 21 in a direction perpendicular to the driving shaft 26. The control valve 40 controls the fluid pressures to be introduced into first and second fluid pressure chambers 43 and 44, divisionally formed on two sides of the cam ring 27 in the adapter ring 29 by the swing fulcrum pin 31 and a seal member 45 axially symmetric to it, in accordance with the rotational speed of the pump.

Although not shown, a path 51 (indicated by a broken line in FIG. 8A) extending from the pump discharge pressure chamber 33 is connected to one end of the valve hole 41.

A spring chamber 46 having a spring 46*a* for biasing the spool 42 to one end side is formed on the other end side of the valve hole 41. The spring 46*a* biases the spool 42 to the right in FIG. 8A. In this embodiment, the spring chamber 46 is connected to a pilot pressure path 54 formed to extend from a pump discharge port 55 serving as the terminal end portion of the pump discharge path in the front body 21.

The spring chamber 46 is connected to the second fluid pressure chamber 44 through a connection path 50. A damper restrictor 50*a* is formed in part of the connection path 50. A high-pressure chamber 48 formed on one end side of the spool 42 is selectively connected to the first fluid pressure chamber 43 through a connection path 47 which is gradually disconnected from the pump discharge side when the spool 42 moves toward the spring chamber 46 (to the left in FIG. 8A).

In FIG. 8A, the connection path 47 is connected to an annular space, formed of an annular groove 42*c* at the central portion in the axial direction of the spool 42, through a gap path formed of a small-diameter portion 42*b* formed in a land 42*a* on one end side of the spool 42. As shown in FIGS. 8A and 10, this annular space is connected to the tank T through a pump suction path 56. A fluid pressure P1 on the pilot pressure path 51 side is selectively connected to the first fluid pressure chamber 43 through the connection path 47 in accordance with the amount of displacement of the spool 42.

The fluid pressure P1 and a fluid pressure P2 obtained upstream and downstream, respectively, of a metering restrictor portion 60 (to be described above) formed midway along the pump discharge path are introduced to the chambers 48 and 46 on two end sides of the control valve 40 through the pilot pressure path 51 and a pilot pressure path 52, respectively.

At the start of operation of the pump and while the pressure fluid utilizing device (PS) operates, the differential pressure between the fluid pressures obtained upstream and downstream of the metering restrictor portion 60 is small. The spool 42 is thus located at the position shown in FIGS. 8A and 10, and a pump suction fluid pressure P0 is introduced to the first fluid pressure chamber 43. At this time, the pump discharge fluid pressure P2 obtained downstream of the metering restrictor portion 60 is introduced to the second fluid pressure chamber 44, and the cam ring 27 maintains the volume of the pump chamber 28 maximum.

When the rotational speed of the pump reaches the medium or high speed range and the pressure fluid utilizing device (PS) is inoperative, the spool 42 moves in a direction to flex the spring 46*a,* and accordingly the chamber 48 connected to the pilot pressure path 51 is connected to the connection path 47. Then, the fluid pressure obtained upstream of the metering restrictor portion 60 is introduced into the first fluid pressure chamber 43 in accordance with the moving amount of the spool 42. As a result, the cam ring 27 swings counterclockwise in FIG. 8A to reduce the volume of the pump chamber 28.

This state is indicated by ⓐ–ⓑ and ⓑ–ⓒ–ⓓ–ⓔ in FIG. 5 described above in the first embodiment. In the control valve 40, the gap path formed by the small-diameter portion 42*b* is in the state shown in FIG. 6A or 6B described above. As the spool 42 moves, the pump suction or discharge fluid pressure is supplied to the first fluid pressure chamber 43, and required supply fluid pressure control is performed.

In this embodiment, as shown in FIGS. 8A and 10, a damper restrictor 51*a* is formed in part of the pilot pressure path 51 to suppress unnecessary movement of the spool 42 accompanying variations in fluid pressure in the pump discharge path. At this time, a fluid pressure P4 acts on the chamber 48.

In this embodiment, the path is formed to have an ordinary diameter. Alternatively, a damper restrictor (e.g., see a portion indicated by reference numeral 54*a* in FIG. 12 to be described later) may be formed in part of the path 54 that connects the pump discharge path located downstream of the metering restrictor portion 60 to the spring chamber 46.

The damper restrictors 47*a* and 50*a* serve to prevent variations in fluid pressure in the first and second fluid pressure chambers 43 and 44 described above, thereby suppressing unnecessary movement of the cam ring 27.

A path 57 partly constituting the pump discharge path is formed to branch from the pump discharge pressure chamber 33 independently of the pilot pressure path 51, and opens to the inner wall on the outer end side of a plug hole 62 provided with a compression coil spring 61. The compression coil spring 61 biases the cam ring 27 in a direction to maximize the volume of the pump chamber 28 on the second fluid pressure chamber 44 side.

A plug 63 is set in the plug hole 62 to close its opening end, as shown in FIG. 8A and FIGS. 9 to 11B. A plunger damper 64 for exerting the biasing force of the compression coil spring 61 on the cam ring 27 is slidably held in a cylindrical portion 63*b* of the plug 63.

In this embodiment, the cylindrical portion 63*b* of the plug 63 and the plunger damper 64 constitute the metering restrictor portion 60.

This will be described in detail. The outer end side of the plunger damper 64 forms a small-diameter portion 64*c,* and an annular path space 65 is formed between the small-diameter portion 64*c* and the inner wall of the cylindrical portion 63*b* of the plug 63.

The path 57 from the pump discharge pressure chamber 33 communicates with the annular path space 65 through a path hole 66 formed radially in the plug 63 from a space between the plug hole 62 of the front body 21 and the plug 63.

The fluid introduced axially in the annular path space 65 is guided to a second path space 70 comprised of small holes 68 and 69 and formed in the cylindrical portion 63*b* of the plug 63 along the axial direction to be defined from the path space 65. The small hole 68 serves as a stationary metering restrictor. The small hole 69 serves as a movable metering restrictor. The second path space 70 communicates with the pump discharge port 55 through a path 71.

The small hole 69 serving as the variable metering restrictor described above can be opened and closed such that its opening area is changed by a step close to the small-diameter portion 64*c* of the plunger damper 64 which moves in the axial direction along with the swing motion of the cam ring 27.

The small hole 69 serving as the variable metering restrictor whose opening area can be changed by the plunger damper 64 may be formed equidistantly at a plurality of locations (four in this embodiment) on the cylindrical portion 63*b* of the plug 63 in the circumferential direction. Obviously, the present invention is not limited to this structure.

Other than the small hole 69, the small holes 68 and path holes 66 may be formed at balanced positions around the plug 63 in the circumferential direction. In this embodiment, the small holes 68 and path holes 66 are formed at two locations.

Referring to FIGS. 8A and 9, the compression coil spring 61 for biasing the cam ring 27 is placed in the plug hole 62 that forms a circular space opposing part of the second fluid pressure chamber 44, and is formed in the cylindrical portion 63*b* of the plug 63 which is screwed into the hole 62 to close its opening end. In the cylindrical portion 63*b,* the plunger damper 64 having one opening end abuts against the outer surface of the cam ring 27 with the spring force of the compression coil spring 61. Accordingly, the biasing force generated by the compression coil spring 61 always acts on the cam ring 27 regardless of the swing motion of the cam ring 27.

In part of the plunger damper 64, a damper restrictor 64*d* is formed, between the plunger damper 64 and the cam ring 27, of a small hole through which the interior where the compression coil spring 61 is disposed communicates with the second fluid pressure chamber 44. In place of the damper restrictor 64*d,* a bleed hole that opens to the atmosphere may be formed in part of the plug 63, and a damper function may be obtained with the compression coil spring 61 and plunger damper 64 by the function of the bleed hole.

Referring to FIGS. 8A and 10, a relief valve 74 is formed in the spool 42 of the control valve 40. The relief valve 74 is connected to the pump discharge port 55, partly forming the pump discharge path, through the spring chamber 46 and pilot pressure path 52. Hence, the pump discharge fluid pressure can be relieved to the pump suction side through the hole 75 formed in the small-diameter portion 42*c* of the spool 42.

In the above vane type variable displacement pump 20, the arrangement other than that described above is identical to that conventionally known widely, and a detailed description thereof will accordingly be omitted.

According to the variable displacement pump 20 having the above structure, the pressure fluid flowing through the discharge paths 57, 62, 66, and 65 from the pump discharge pressure chamber 33 is guided to the metering restrictor portion 60 comprised of the stationary metering restrictor (small hole 68) and a variable metering restrictor (small hole 69) which are formed of the plunger damper 64 and plug 63 constituting the damper functional portion. The pressure fluid that has passed through the metering restrictor portion 60 reaches the pump discharge port 55 through the discharge paths 70 and 71, and is supplied to a power cylinder PS of a power steering device serving as a pressure fluid utilizing device (not shown).

The fluid pressures obtained upstream of the metering restrictors 68 and 69 are introduced to one chamber 48 of the control valve 40 through the pilot pressure path 51. Hence, with the fluid pressure and the pump suction fluid pressure (tank pressure), the control pressure controlled by the control valve 40 is introduced into the first fluid pressure chamber 43 located on one side in the swing direction of the cam ring 27. The fluid pressures obtained downstream of the metering restrictors 68 and 69 are introduced into the second fluid pressure chamber 44, located on the other side in the swing direction of the cam ring 27, through the pilot pressure path 54, spring chamber 46, and path 50.

With this structure, the cam ring 27 can be swung in a required state in accordance with the magnitude of the pump discharge flow rate, and the supply flow rate to the pump discharge side can be controlled to be maintained at a predetermined value, or an arbitrary value equal to or less than the predetermined value, as the rotational speed of the pump increases, as shown in FIG. 5 described in the first embodiment.

Referring to FIG. 5, when the rotational speed of the pump increases from a low speed range to a medium speed range, the supply flow rate changes as indicated by ⓐ–ⓑ and ⓒ. As shown in FIG. 6A described in the first embodiment, when the pump rotates at a low rotational speed, the control valve 40 guides the pump suction fluid pressure (tank pressure) to the first fluid pressure chamber 43 through the path hole 47 and a damper restrictor 47*a,* to maintain a constant supply flow rate determined by the differential pressure obtained from the restriction amounts of the metering restrictors 68 and 69.

When the rotational speed of the pump reaches a high speed range, the spool 42 of the control valve 40 moves to the left, as shown in FIG. 6A described in the first embodiment, to switch the pressure in the path hole 47 extending to the first fluid pressure chamber 43 to the fluid pressure obtained upstream of the metering restrictor 68 or 69. Accordingly, the cam ring 27 swings toward the second fluid pressure chamber 44 where the compression coil spring 61 is provided, to gradually close the small holes 69 serving as variable metering restrictor with the large-diameter portion of the plunger damper 64 in accordance with the movement of the plunger damper 64 moved by the swing motion of the cam ring 27.

When the small holes 69 constituting the variable metering restrictor are completely closed by the large-diameter portion of the plunger damper 64 in accordance with the movement of the cam ring 27, the control valve 40 is controlled by the differential pressure between the fluid pressures obtained upstream and downstream of the small hole 68 serving as the stationary metering restrictor, so that the determined flow rate can be maintained (indicated by ⓓ–ⓔ in FIG. 5 described in the first embodiment). These flow rate characteristics are so-called drooping characteristics.

When the relationship between the small holes 69 constituting the variable metering restrictor and the opening amount determined by the displacement of the large-diameter portion of the plunger damper 64 is changed, the flow rate characteristics shown in FIG. 5 described in the first embodiment can be changed.

In the second embodiment, the small holes 69 described above are formed as circular holes formed equidistantly in the outer surface of the cylindrical portion 63*b* of the plug 63, that holds the plunger damper 64, in the circumferential direction. However, the present invention is not limited to this, and one small hole or a plurality of small holes may be formed. When a plurality of small holes 69 are to be formed, the shape of the holes need not be circular but can be elliptic or rectangular. Depending on the required characteristics, a plurality of holes may be formed to be shifted from each other in the axial direction.

The first and second fluid pressure chambers 43 and 44 for swinging the cam ring 27 are connected to the control valve 40 and the pump discharge path (pump discharge port 55) through the damper restrictors 47*a* and 50*a*. When the cam ring 27 swings in accordance with the differential pressure between the fluid pressures obtained upstream and downstream of the stationary metering restrictor 68 and the differential pressure between the fluid pressures obtained upstream and downstream of the variable metering restrictor 69 due to an increase/decrease in rotational speed of the pump, a required braking force can be applied to the cam ring 27 in two swing directions.

According to this structure, an appropriate braking force can be applied to the cam ring 27 when it swings toward the first or second fluid pressure chamber 43 or 44. The cam ring 27 can thus be swung smoothly in a required state so the cam ring 27 does not vibrate or pulsation is not produced on the pump discharge side.

In the second embodiment, it suffices if the path hole 50 having the damper restrictor 50*a* described above is formed downstream of the variable metering restrictor 60. Hence, in place of the spring chamber 46 of the control valve 40, the second fluid pressure 44 can be made to directly communicate with the discharge port 55 (downstream of the variable metering restrictor 60) through, e.g., a restrictor hole 82 indicated by broken lines in FIG. 8A.

In this case, the pilot pressure path 54 serves to guide the fluid pressure obtained downstream of the metering restrictor portion 60 to the spring chamber 46 of the control valve 40. Also, the pressure fluid from the pump discharge path is guided to the relief valve 74, formed in the spool 42, through the pilot pressure path 54.

In this embodiment, the biasing force of the compression coil spring 61 serving as the biasing means is exerted on the cam ring 27 through the plunger damper 64. Therefore, a biasing force and a braking force can be appropriately exerted on the cam ring 27, and a smooth swing motion can be obtained more effectively. Also, since the opening area of the variable metering restrictor 69 is changed by the movement of the plunger damper 64, the function as the variable metering restrictor can be exhibited.

In the above embodiment, the plunger damper 64 and plug 63 form the variable metering restrictor. Therefore, the variable displacement pump 20 can be converted from a drooping type pump to a constant flow rate type pump by only omitting the variable metering restrictor.

When this structure is employed, of the variable displacement pump 20, components except for those constituting the variable metering restrictor can be shared between the drooping type pump and the constant flow rate type pump, and any change in specification can be coped with simply.

In this embodiment, since the relief valve 74 can be incorporated in the spool 42 constituting the control valve 40, the front body 21 can be more prevented from projecting outwardly than in a case wherein the relief valve 74 is provided in any other portion of the front bodies 21 and 22, so that the entire pump can be made compact.

In this embodiment, the hole for housing the relief valve 74 can be machined easily, and the valve spool 42 is used as the holder. Therefore, the number of components and the cost can be reduced.

According to the present invention, the control valve 40 is a valve operated by the pilot pressure, and the pump discharge fluid pressure is not positively flowed into the control valve 40. Therefore, the valve hole of the control valve 40 can be machined easily.

Figure 12:
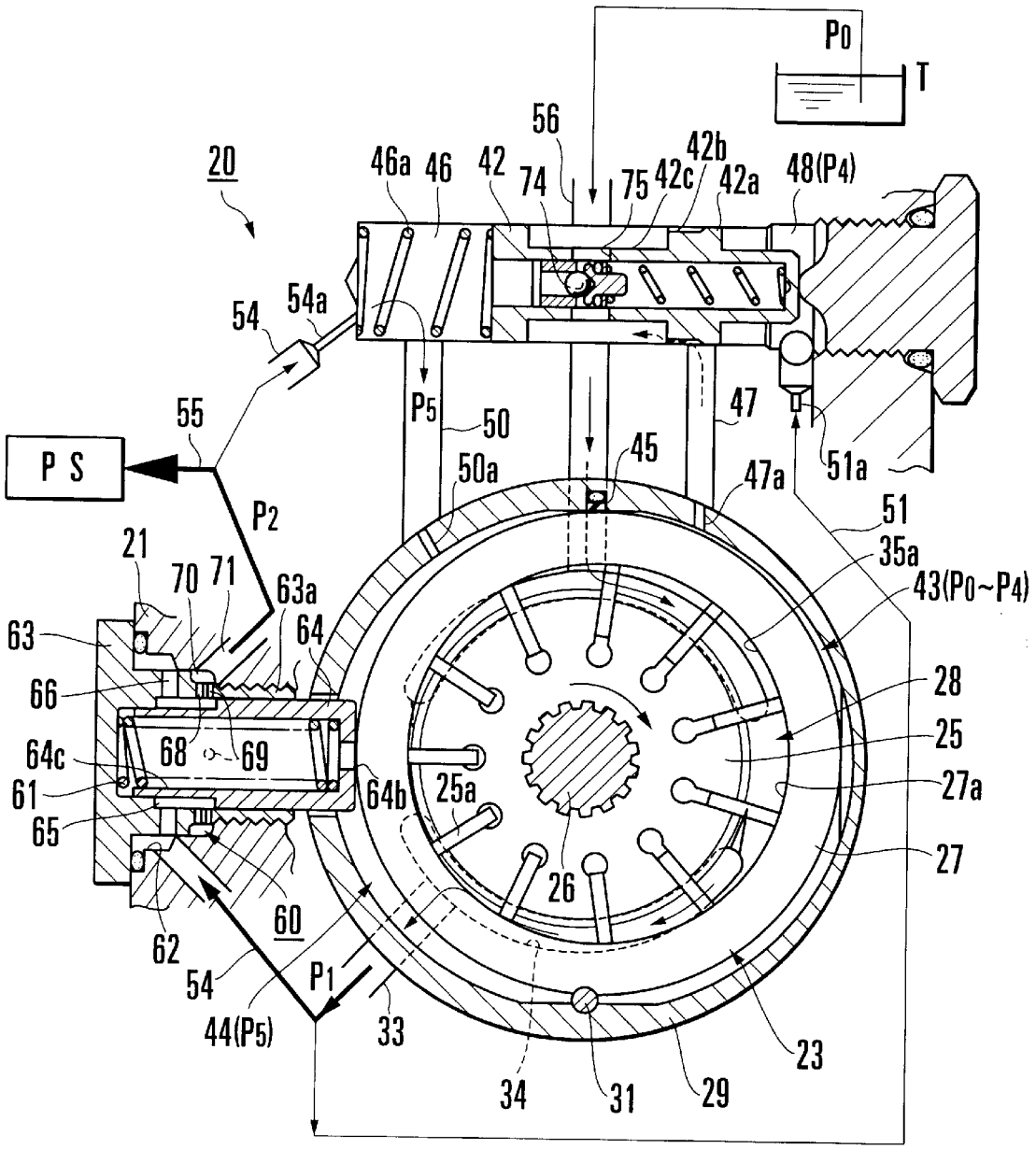
FIG. 12 is a view showing a variable displacement pump having drooping type flow rate characteristics according to the third embodiment of the present invention to explain the outline of the entire flow of the fluid in the variable displacement pump.

FIG. 12 shows a variable displacement pump 20 according to the third embodiment of the present invention. Referring to FIG. 12, components identical or corresponding to those in FIGS. 8A to 11B described above are denoted by the same reference numerals as in FIGS. 8A to 11B, and a detailed description thereof will be omitted.

The pump according to the third embodiment is a variable displacement pump having so-called drooping characteristics, in the same manner as in the second embodiment, with which as the rotational speed of the pump increases, the supply flow rate on the pump discharge side is decreased to be smaller than the maximum flow rate.

In this embodiment, different from the second embodiment described above, a pilot restrictor 54*a* is formed in a pilot pressure path 54 which connects a spring chamber 46 of a control valve 40 to the downstream side of a metering restrictor portion 60 on the pump discharge side.

In the presence of the pilot restrictor 54*a,* when a relief valve 74 performs relief operation, the pressure in the spring chamber 46 of the control valve 40 drops. Thus, a supply fluid pressure P5 to be supplied to a second fluid pressure chamber 44, on a side where the volume a pump chamber 28 of a cam ring 27 becomes the maximum volume, can be decreased.

In the pump having this pilot restrictor 54*a,* when the relief valve 74 performs relief operation, the cam ring 27 can be swung in a direction to decrease the volume of the pump chamber 28. Since the discharge amount from the pump can accordingly be further decreased, energy saving of the pump can be achieved.

According to this structure, of the flow rate obtained through the metering restrictor portion 60 formed in the pump discharge path and comprised of the stationary metering restrictor and the variable metering restrictor, only a flow rate decreased by a value corresponding to a value inversely proportional to the restriction amount of the pilot restrictor 54*a* is relieved to the pump suction side through the relief valve 74. Therefore, the relief valve 74 of this embodiment is a so-called quasi-direct driven type pump the relief amount of which is somewhat smaller than in a direct driven type pump in which the pressure fluid in the pump discharge path is entirely relieved as in the embodiments described above.

With the pilot restrictor 54*a* described above, an adverse influence accompanying variations in fluid pressure to be supplied to a spool 42 of the control valve 40 can be prevented.

Figure 13:
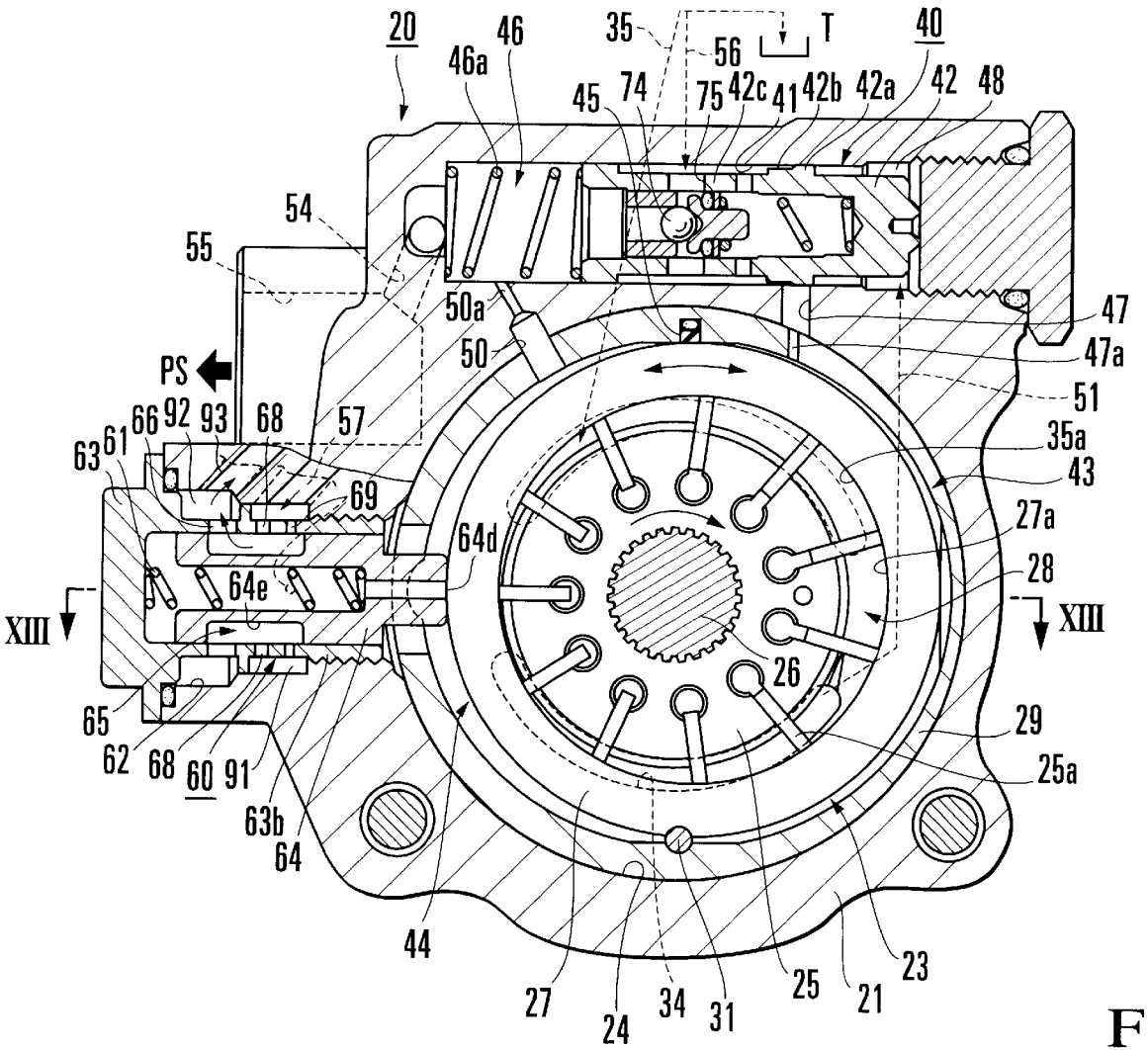
FIG. 13 is a sectional view of the main part of a variable displacement pump having drooping type flow rate characteristics according to the fourth embodiment of the present invention, in a state wherein the pump rotates at a low rotational speed.
Figure 14:
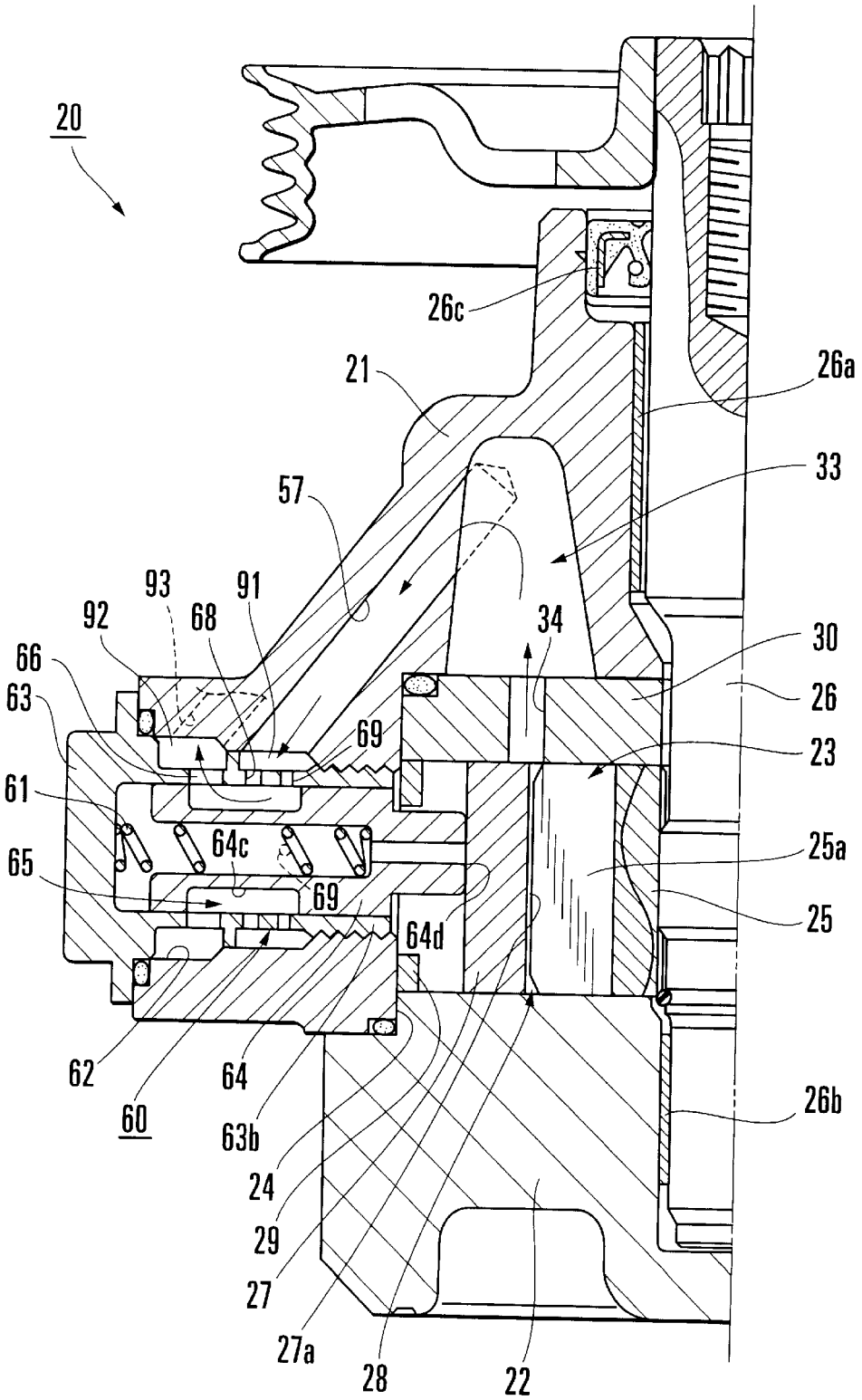
FIG. 14 is a sectional view of one side taken along the line XIII—XIII of FIG. 13.

FIGS. 13 and 14 show a variable displacement pump 20 according to the fourth embodiment of the present invention. Referring to FIGS. 13 and 14, components identical or corresponding to those in FIGS. 1 to 7B, FIGS. 8A to 11B, and FIG. 12 described above are denoted by the same reference numerals as in FIGS. 1 to 7B, FIGS. 8A to 11B, and FIG. 12, and a detailed description thereof will be omitted.

The pump according to the fourth embodiment is a variable displacement pump having so-called drooping characteristics, in the same manner as in the first, second, and third embodiments.

In this embodiment, an annular groove 64*e* is formed in the outer surface of a plunger damper 64. A compression coil spring 61 for biasing a cam ring 27 in a direction to maximize the volume of a pump chamber 28 is disposed in the plunger damper 64. An annular path space 65 is formed, in the annular groove 64*e,* with respect to the inner wall of a cylindrical portion 63*b* of a plug 63.

A path 57 extending from a pump discharge pressure chamber 33 communicates with a first path space 91 formed annularly between the outer surface at substantially the central portion in the axial direction of the cylindrical portion 63*b,* and a plug hole 62 of a body 21. A plurality of small holes 68 serving as stationary metering restrictors and a plurality of small holes 69 serving as movable metering restrictors are axially formed in a portion of the cylindrical portion 63*b* corresponding to the first path space 91 so as to form a metering restrictor portion 60. The opening areas of the small holes 69 serving as the variable metering restrictors are changed by the groove end edge portion of the annular groove 64*e* of the plunger damper 64 which moves in the axial direction along with the swing motion of the cam ring 27.

Accordingly, the pump discharge fluid flowing from the pump discharge path 57 into the first path space 91 flows into the annular path space 65, comprised of the annular groove 64*e* of the plunger damper 64, through the small holes 68 and 69 constituting the metering restrictor portion 60. Hence, the interior of the annular path space 65 is set at a fluid pressure obtained downstream of the metering restrictor portion 60.

The fluid obtained downstream of the restrictor portion and flowing into the annular path space 65 flows in the path space 65 in a direction to separate from the cam ring 27, and is guided to a second path space 92, formed annularly in a portion on the outer surface of the cylindrical portion 63*b* close to the opening end of the plug hole 62, through a path hole 66 formed in the cylindrical portion 63*b* of the plug in the radial direction. The second path space 92 communicates with the pump discharge port 55 through the path hole 93 constituting the pump discharge path.

The fourth embodiment is different from the second and third embodiments described above in that the fluid pressure obtained downstream of the metering restrictor portion 60 is introduced into the annular path space 65 comprised of the annular groove 64*e* of the plunger damper 64.

According to this arrangement, the pressure in a second fluid pressure chamber 44 can be set almost equal to the pressure in a space in the plunger damper 64 where the compression coil spring 61 is provided.

In the second and third embodiments described above, internal leakage of the pump discharge fluid may occur because the fluid pressure (pressure identical to that of the second fluid pressure chamber 44 communicating with the fluid pressure obtained downstream of the metering restrictor portion 60) in the plunger damper 64 where the compression coil spring 61 is provided is lower than the fluid pressure in the annular path space 65 which is the pressure obtained upstream of the metering restrictor portion 60. However, according to the structure of the fourth embodiment, such a problem does not arise.

More specifically, in order to prevent internal leakage described above, leakage preventive countermeasures are required, e.g., the inner surface of the cylindrical portion 63*b* and the outer surface of the plunger damper 64 may be machined at high precision, or seal member may be interposed between them, leading to an increase in cost. In order to ensure the high machining precision described above, these components must be machined at high precision by lathe machining or the like. When internal leakage occurs, depending on the leakage amount, the fluid flow rate decreases on the pump discharge side, and so-called N (rotational speed of pump)–Q (discharge flow rate of fluid) characteristics vary.

As described above, when the fluid pressure obtained upstream of the metering restrictor portion 60 is introduced to the path space 65 around the plunger damper 64, a thrust in a direction to interfere with the swing displacement of the cam ring 27 may undesirably act on the plunger damper 64.

More specifically, since the distal end portion of the plunger damper 64 opposes the second fluid pressure chamber 44 and abuts against the outer surface of the cam ring 27, the end portion of the plunger damper 64 on the cam ring side is under a pressure obtained by controlling the fluid pressure obtained downstream of the metering restrictor portion 60. Since a fluid pressure obtained upstream of the metering restrictor portion 60 acts on the opposite side of the plunger damper 64, a thrust in a direction to press the cam ring 27 acts on the plunger damper 64. Accordingly, the smooth swing motion of the cam ring 27 is interfered with, and variable adjustment of the pump discharge flow rate cannot be performed appropriately.

In contrast to this, according to the fourth embodiment, the fluid pressure in the path space 65 comprised of the O-ring 64*a* formed in the outer surface of the plunger damper 64 is set at the pressure obtained downstream of the metering restrictor portion 60. The pressure in the path space 65 thus becomes almost equal to the fluid pressure in the plunger damper 64, and the internal leakage as described above does not arise. Countermeasures for ensuring strict machining precision and sealing performance at these portions become unnecessary, thus decreasing the cost.

According to this structure, since the fluid pressures on the two end sides of the plunger damper 64 become almost equal to each other, the plunger damper 64 presses the cam ring 27 with the biasing force of the compression coil spring 61, so that the cam ring 27 can perform a required motion.

The flow of the hydraulic oil in this embodiment will be described. As shown in FIGS. 13 and 14, the hydraulic oil discharged from the pump chamber 28 flows through a pump discharge opening 34 and is guided to the first path space 91 between the plug hole 62 of the front body 21 and the cylindrical portion 63*b* through the pump discharge pressure chamber 33 and pump discharge path 57. The hydraulic oil then flows from the first path space 91 to the path space 65 around the plunger damper 64 through the small holes 68 and 69, formed in the cylindrical portion 63*b* of the plug to constitute the metering restrictor portion 60, and is then guided to the second path space 92 defined by the plug hole 62 through the path hole 66 formed in the cylindrical portion 63*b*. The hydraulic oil flows from the second path space 92 to the path hole 93 and is discharged to outside the pump through a pump discharge port 55.

In this embodiment, the path space 65 formed of the annular groove 64*e* around the plunger damper 64 is set at a fluid pressure obtained downstream of the metering restrictor portion 60. Therefore, all of the housing space in the cylindrical portion 63*b* for housing the plunger damper 64, two end sides of the plunger damper 64, and the path space 65 formed of the annular groove 64*e* in the plunger damper 64 are set at the fluid pressure obtained downstream of the metering restrictor portion 60, leading to a balanced state in terms of the fluid pressure.

According to this structure, even when the plunger damper 64 is provided, a thrust that suppress the swing motion of the cam ring 27 is not produced in the plunger damper 64. The cam ring 27 can be swung smoothly and appropriately, and can be suppressed from unwanted vibration.

Since internal leakage of the fluid pressure does not occur near the plunger damper 64, the N–Q characteristics (rotational speed—supply flow rate characteristics) of the pump can be stabilized. Since the problem of internal leakage does not arise, high machining precision is not needed for the plunger damper 64 and the cylindrical portion 63*b* that holds the plunger damper 64. The plunger damper 64 and cylindrical portion 63*b* can be formed of molded components such as sintered components, thus reducing the manufacturing cost.

Figure 15:
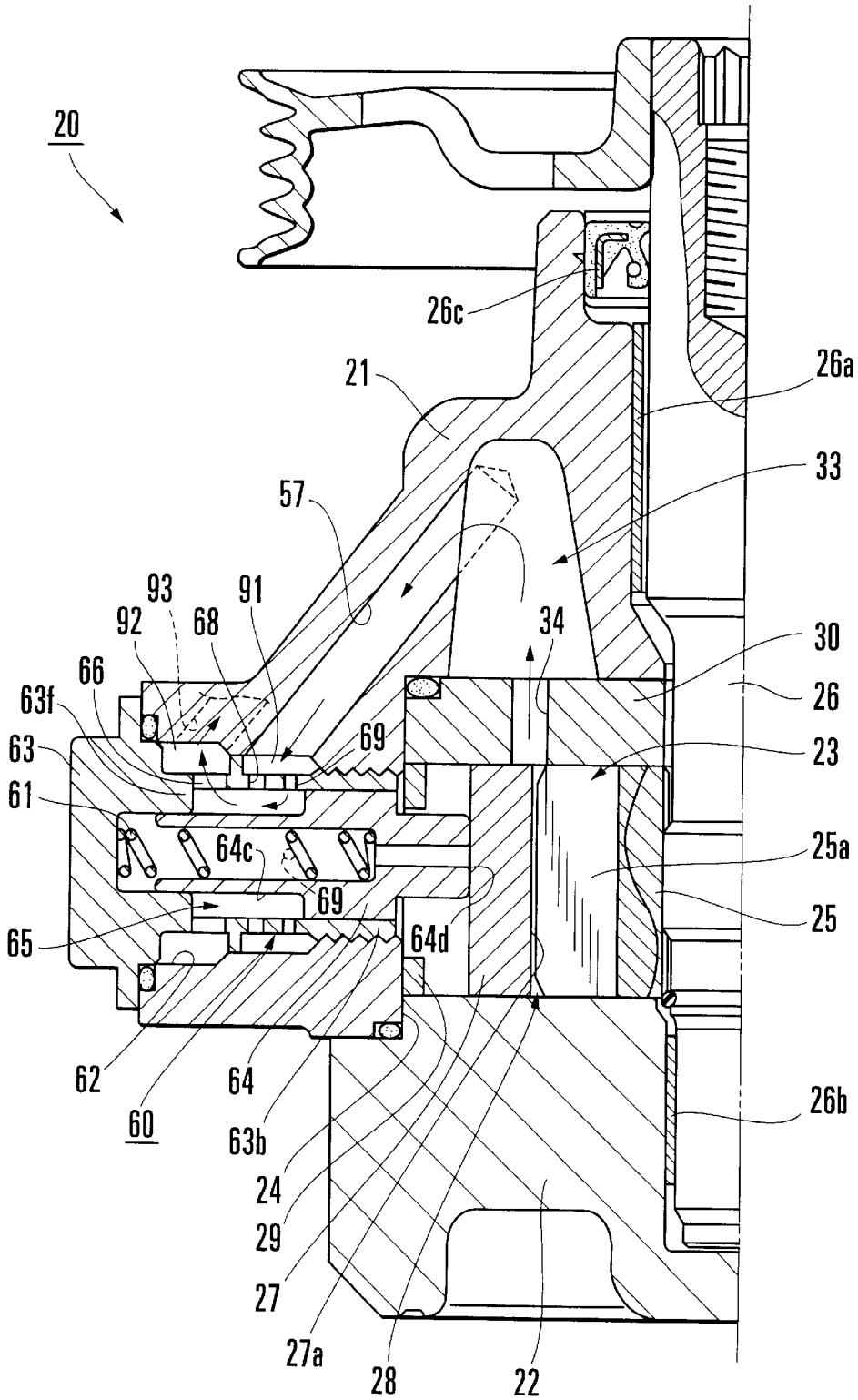
FIG. 15 is a sectional view showing a modification of FIG. 14.
Figure 16:
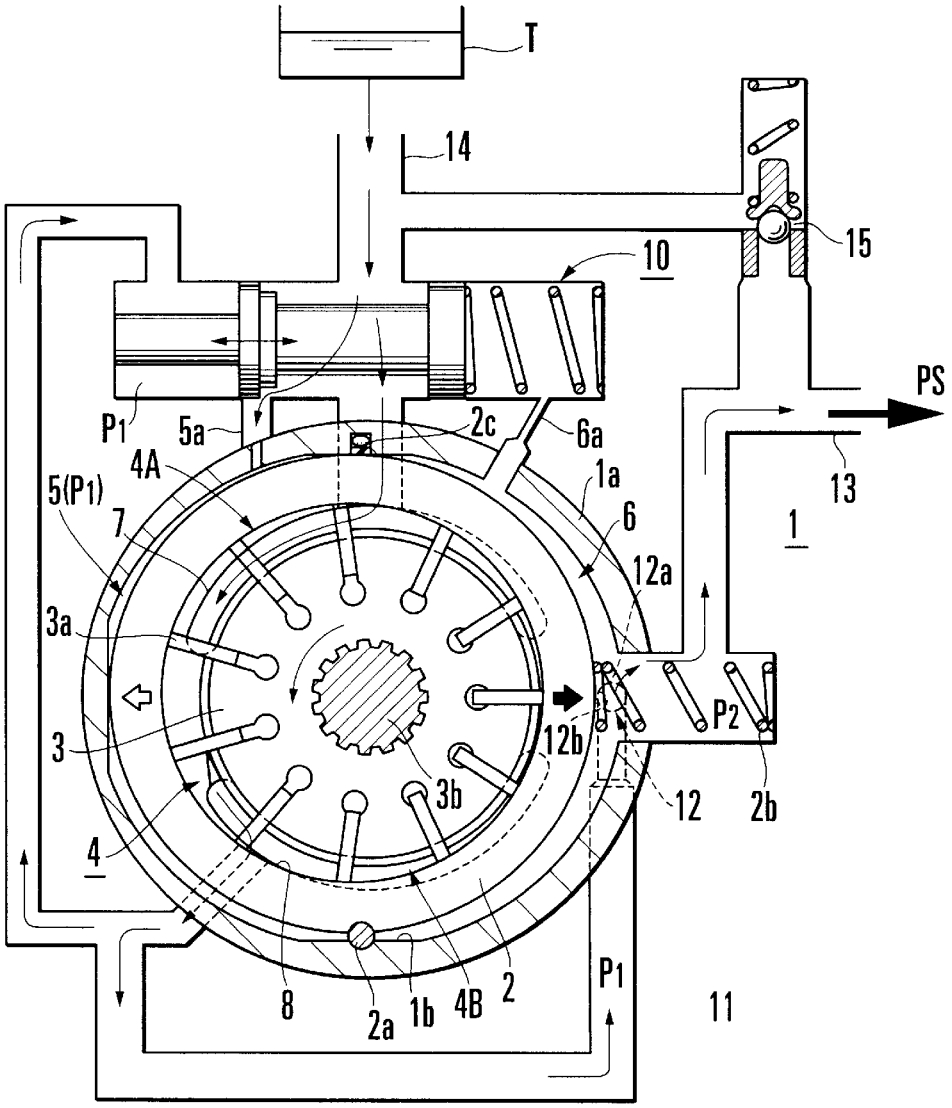
FIG. 16 is a view for explaining the operation of a conventional variable displacement pump in a state wherein the pump rotates at a low speed.
Figure 17:
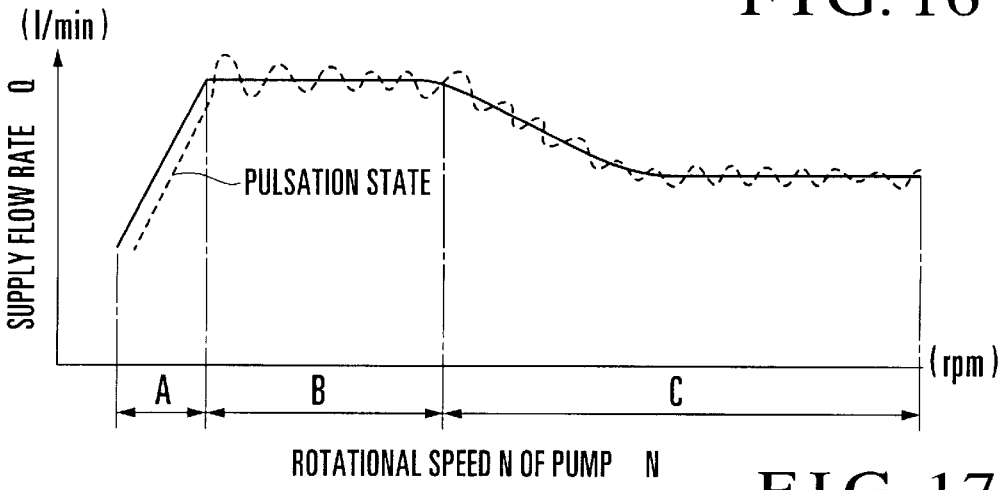
FIG. 17 is a graph for explaining the supply flow rate of the pump of FIG. 16 with respect to the rotational speed of the pump.

FIG. 15 shows a modification of the fourth embodiment described above. In the fifth embodiment, when forming an annular path space 65 around a plunger damper 64, a small-diameter portion 64*c* is formed, as in the second embodiment described above, and an inner-diameter portion 63*f* for holding the distal end portion of the small-diameter portion 64*c* is formed in a plug 63.

With this structure as well, a function and an effect identical to those of the fourth embodiment described above can be obviously obtained, and a detailed description thereof will be omitted.

The present invention is not limited to the structures of the embodiments described above. The shapes, structures, and the like of the respective components of the variable displacement pump 20 can be arbitrarily modified or changed freely when necessary, and various modifications can be possible.

In the embodiments described above, the metering restrictors are explained merely as "restrictors", as in the stationary metering restrictor 53 and the variable metering restrictor 59, or the stationary metering restrictor and the variable metering restrictor which constitute the metering restrictor portion and which are comprised of the small holes 68 and 69 formed in the plug 63 and of the plunger damper 64 which changes the opening area of the small hole 69, among the small holes 68 and 69. This is because these restrictor portions can be either orifices or chokes.

As has been described above, in the variable displacement pump according to the present invention, the first and second fluid chambers formed on two sides of the cam ring are formed to be partitioned from the pump discharge path, and a damper function is added to each fluid chamber, so that the damper function can appropriately be effected in both of the swing directions of the cam ring. As a result, a required braking force can be applied to the motion of the cam ring to the two swing directions. Vibration that occurs when the cam ring swings can be attenuated appropriately, and pulsation on the pump discharge side can be improved.

Hence, the conventional problem of noise can be decreased.

According to the present invention, the pump discharge fluid pressure is supplied not through the control valve but through the damper functional portion which applies a biasing force to the cam ring, and the plunger damper constituting the damper functional portion, and the plug constitute the metering restrictor. The supply flow rate characteristics with respect to the rotational speed of the pump can be adjusted or changed easily by only altering this damper functional portion.

According to the present invention, since the metering restrictor portion comprised of the stationary metering restrictor and the variable metering restrictor is provided to the plunger damper portion, vibration produced when the cam ring swings is not directly transmitted to the metering restrictor portion. Therefore, pulsation in the pressure fluid passing through the metering restrictor portion can be decreased. Moreover, such a plunger damper can be easily added when necessary, so that the conventional pump can be converted comparatively easily.

According to the present invention, the pump discharge fluid pressure flowing through the annular path space formed between the plunger damper and the cylindrical member that holds the plunger damper can be set at the fluid pressure obtained downstream of the metering restrictor portion, and can be set almost equal to the fluid pressures on two end sides of the plunger damper. Therefore, internal leakage from the pump discharge path does not occur, and the supply flow rate characteristics (N–Q characteristics) as the pump can be maintained at a required state.

According to the present invention, even when the plunger damper is provided, a thrust that suppresses the swing motion of the cam ring is not produced in the plunger damper by the fluid pressure. The cam ring can be swung smoothly and appropriately, and unwanted vibration of the cam ring can be suppressed.

Since the present invention is free from the problem of internal leakage, high machining precision is not required for the plunger damper and the cylindrical member that holds the plunger damper. The plunger damper and the cylindrical member can be comprised of molded components such as sintered components, thus decreasing the manufacturing cost.

According to the present invention, when the variable metering restrictor is formed in the metering restrictor portion, a pump having drooping type flow rate characteristics can be obtained. When the variable metering restrictor is omitted, a pump having constant volume type flow rate characteristics can be obtained.

According to the present invention, since the stationary metering restrictor and the variable metering restrictor can be provided to the two branch discharge path systems, the damper function can be appropriately effected in both of the swing directions of the cam ring. As a result, vibration that occurs when the cam ring swings can be attenuated appropriately, and pulsation on the pump discharge side can be improved to reduce the noise problem.

According to the present invention, when constituting a pump having drooping type flow rate characteristics, a pump discharge path structure having two systems respectively extending through the stationary metering restrictor and the variable metering restrictor is employed. Therefore, the supply flow rate characteristics with respect to the rotational speed of the pump can be adjusted and altered easily.

According to the present invention, since one system of the pump discharge path is formed to extend through the control valve, pulsation can be reduced. Also, a variable displacement pump having the advantages described above can be formed easily to have the same size as that of the conventional pump.

According to the present invention, since the variable metering restrictor is provided to the plunger damper portion, vibration produced when the cam ring swings is not directly transmitted to the variable metering restrictor. Therefore, pulsation in the pressure fluid passing through the variable metering restrictor can be decreased. Moreover, such a plunger damper can be easily added when necessary, so that the conventional pump can be altered easily.

What is claimed is:

1. A variable displacement pump comprising:

pump bodies having an inner space and formed with a pump suction path and pump discharge paths communicating with said inner space;

a cam ring swingably supported in said inner space of said pump bodies through a swing fulcrum formed on part of an outer surface of said cam ring to extend in an axial direction;

first and second fluid pressure chambers divisionally formed in said inner space of said pump bodies with respect to said outer surface of said cam ring through seal means;

a rotor having a plurality of vanes and arranged inside said cam ring;

a rotating shaft axially supported by said pump bodies and mounted with said rotor;

a pump chamber having an opening for said suction path and an opening for said discharge paths and formed between an inner surface of said cam ring and an outer surface of said rotor;

biasing means for biasing said cam ring from said second fluid pressure chamber toward said first fluid pressure chamber;

a metering restrictor provided midway along said discharge paths of a pressure fluid discharged from said pump chamber; and a control valve connected to said discharge paths formed upstream and downstream, respectively, of said metering restrictor and to said first and second fluid pressure chambers and driven by fluid pressures obtained upstream and downstream of said metering restrictor, wherein a plunger damper is formed to incorporate said biasing means such that a distal end thereof abuts against a side portion of said cam ring in said second fluid pressure chamber, and a variable metering restrictor constituting said metering restrictor is formed at a position, where said variable metering restrictor is opened/closed by a slidable motion of said plunger damper during a swing motion of said cam ring and is partitioned from said second fluid pressure chamber, so that an opening area of said variable metering restrictor changes in an interlocking manner to the swing motion of said cam ring.

2. A pump according to claim 1, wherein a stationary metering restrictor constituting said metering restrictor is provided at a position where said stationary metering restrictor is close to said variable metering restrictor and is not opened/closed by the slide motion of said plunger damper.

3. A pump according to claim 1, wherein pilot pressure paths are respectively provided to chambers formed on two end sides of said control valve to introduce fluid pressures obtained upstream and downstream, respectively, of said metering restrictor, a flow channel having a damper restrictor is formed between said control valve and said first fluid pressure chamber to selectively introduce the fluid pressure obtained upstream of said metering restrictor and a pump suction fluid pressure into said first fluid pressure chamber in accordance with operation of said control valve, and a flow channel having a damper restrictor is formed between said control valve and said second fluid pressure chamber to introduce the fluid pressure obtained downstream of said metering restrictor into said second fluid pressure chamber.

4. A pump according to claim 3, wherein at least one of said pilot pressure paths has a pilot restrictor.

5. A pump according to claim 1, wherein said pump has a cylindrical member for slidably holding said plunger damper and for forming a first path space to which a pump discharge path extending from said pump chamber is connected, and a second path space to which a pump discharge path extending to a pump discharge port is connected, to be separate from each other in an axial direction between said pump bodies and an outer surface of said cylindrical member, first and second holes through which an inner portion and an outer portion of said pump communicate with each other are formed at positions of said cylindrical member corresponding to said path spaces, and a path space through which said holes communicate with each other is formed by a small-diameter portion formed around said plunger damper with respect to an inner surface of said cylindrical member.

* * * * *